US011565396B2

(12) United States Patent
Yoshikane et al.

(10) Patent No.: US 11,565,396 B2
(45) Date of Patent: Jan. 31, 2023

(54) COUPLING MEMBER FOR ELECTRIC POWER TOOL

(71) Applicant: MAKITA CORPORATION, Anjo (JP)

(72) Inventors: Kiyonobu Yoshikane, Anjo (JP); Shuchun Wang, Kunshan Development Zone (CN)

(73) Assignee: MAKITA CORPORATION, Anjo (JP)

( * ) Notice: Subject to any disclaimer, the term of this patent is extended or adjusted under 35 U.S.C. 154(b) by 182 days.

(21) Appl. No.: 16/981,648

(22) PCT Filed: Mar. 8, 2019

(86) PCT No.: PCT/JP2019/009283
§ 371 (c)(1),
(2) Date: Sep. 16, 2020

(87) PCT Pub. No.: WO2019/181557
PCT Pub. Date: Sep. 26, 2019

(65) Prior Publication Data

US 2021/0107130 A1 Apr. 15, 2021

(30) Foreign Application Priority Data

Mar. 23, 2018 (JP) ..... JP2018-055485

(51) Int. Cl.
*B25F 5/02* (2006.01)
*B25H 3/00* (2006.01)
*B25B 21/00* (2006.01)

(52) U.S. Cl.
CPC ..... *B25F 5/02* (2013.01); *B25H 3/006* (2013.01); *B25B 21/00* (2013.01)

(58) Field of Classification Search
CPC ..... B25F 5/02; B25H 3/006; B25B 21/00
See application file for complete search history.

(56) References Cited

U.S. PATENT DOCUMENTS 6,655,560 B2 * 12/2003 Kahn ..... A45F 5/02 224/904
6,835,032 B1 * 12/2004 Pozgay ..... B25G 3/18 409/181

(Continued)

FOREIGN PATENT DOCUMENTS

CN 205085941 U 3/2016
JP 2005-199396 A 7/2005

(Continued)

OTHER PUBLICATIONS

May 28, 2019 International Search Report issued in International Patent Application No. PCT/JP2019/009283.

(Continued)

*Primary Examiner* — Nathaniel C Chukwurah
*Assistant Examiner* — Lucas E. A. Palmer
(74) *Attorney, Agent, or Firm* — Oliff PLC

(57) ABSTRACT

A coupling member for an electric power tool is provided. The coupling member can keep a hanging member being held, even when a holding portion of the tool for holding the hanging member breaks. A coupling member for an electric power tool is configured to hook a hanging member to an electric power tool main body and can fasten the electric power tool main body therein, when one of its parts opens or closes. Further, this coupling member can be attached to the electric power tool main body with the electric power tool main body fastened therein or removed therefrom. Further, the hanging member can be hooked to the coupling member.

20 Claims, 25 Drawing Sheets

(56) References Cited

U.S. PATENT DOCUMENTS 9,986,815 B2 * 6/2018 Moreau ..... A45F 5/021
2005/0011919 A1 * 1/2005 Durham ..... A45F 5/021 224/248
2006/0070761 A1 * 4/2006 Vahabi-Nejad ..... B25C 7/00 173/171
2006/0237498 A1 * 10/2006 Piatt ..... A45F 5/02 224/904
2007/0114141 A1 * 5/2007 Mikesell ..... B25H 3/006 206/207
2008/0185410 A1 * 8/2008 Oomori ..... B25F 5/029 224/269
2009/0025515 A1 * 1/2009 Shibata ..... B25F 5/02 81/57.4
2009/0278012 A1 * 11/2009 Okouchi ..... B25F 5/02 248/304
2010/0031781 A1 * 2/2010 Ito ..... B25H 3/006 173/217
2010/0044405 A1 * 2/2010 Albert ..... F41C 33/041 224/678
2011/0139479 A1 * 6/2011 Nagasaka ..... B25F 5/02 173/217
2012/0085560 A1 * 4/2012 Kuroyanagi ..... B25F 5/02 248/692
2013/0062498 A1 * 3/2013 Ito ..... B25B 21/00 248/672
2014/0298664 A1 * 10/2014 Van Bijsterveldt ..... B27B 17/0008 30/298.4
2015/0136434 A1 * 5/2015 Aoki ..... B25F 5/02 248/691
2017/0021490 A1 * 1/2017 Francis ..... C08F 220/00
2017/0119137 A1 * 5/2017 Cirincione, II ..... B25H 3/00
2018/0132600 A1 * 5/2018 Moreau ..... A45C 13/30
2018/0304454 A1 * 10/2018 Kawakami ..... B25F 5/02
2018/0345441 A1 * 12/2018 Nix ..... B25F 5/02
2019/0337142 A1 * 11/2019 Hays ..... B25F 5/02
2019/0374014 A1 * 12/2019 Flores ..... B23B 45/003
2020/0194747 A1 * 6/2020 Rudolph ..... H01M 50/529
2020/0316766 A1 * 10/2020 Machida ..... B25H 3/00
2021/0001418 A1 * 1/2021 Nakashima ..... B27G 19/04
2021/0237249 A1 * 8/2021 Fischer ..... B25F 5/006

FOREIGN PATENT DOCUMENTS

JP 2011-140110 A 7/2011
JP 2012-081532 A 4/2012
JP 2013-082070 A 5/2013
JP 2016-101621 A 6/2016
JP 2016-124051 A 7/2016
JP 2017-189822 A 10/2017

OTHER PUBLICATIONS

May 28, 2019 Written Opinion of the International Searching Authority issued in International Patent Application No. PCT/JP2019/009283.

* cited by examiner

COUPLING MEMBER FOR ELECTRIC POWER TOOL

CROSS-REFERENCE TO RELATED APPLICATIONS

The present application is a U.S. National Phase entry of, and claims priority to, PCT Application No. PCT/JP2019/009283, filed Mar. 8, 2019, which claims priority to Japanese Patent Application No. 2018-055485, filed Mar. 23, 2018, both of which are incorporated herein by reference in their entireties for all purposes.

BACKGROUND

The present disclosure relates to a coupling member for an electric power tool, more specifically, a coupling member for an electric power tool, which serves to hook a hanging member to an electric power tool main body.

Conventionally, various measures have been taken to prevent an electric power tool from falling from a height during work. Here, Patent Literature 1 (Japanese Laid-Open Patent Publication No. 2005-199396) discloses an electric power tool provided with a strap, which can be hooked to a hook or the like attached to a handrail or a scaffold (hereinafter, referred to as a "hook at workplace"). Herewith, for example, even when a hand-held electric power tool is accidentally dropped, the dropped electric power tool can be kept suspended to the hook at workplace via the strap, when the front end of the strap is hooked to the hook at workplace. As a result, the dropped electric power tool can be prevented from being damaged, since the electric power tool does not collide against the floor (the electric power tool does not receive an impact from the floor).

However, according to a technique as described above in Patent Literature 1, the electric power tool may break due to an impact against the floor caused by being dropped, if the hand-held electric power tool is accidentally dropped before the strap is hooked to the hook at workplace. In this case, because a holding portion of the electric power tool for holding the strap (for example, a loop handle when the electric power tool is a hammer drill) breaks, this strap could not be kept being held afterwards.

The present disclosure is to solve this problem, and the object thereof is to provide a coupling member for an electric power tool, which can keep the hanging member being held even if the holding portion that holds the hanging member breaks.

BRIEF SUMMARY

According to one aspect of the present disclosure, a coupling member of an electric power tool, which allows a hanging member to be hooked to an electric power tool main body, is configured to be able to be fastened to the electric power tool main body when part or it opens or closes. Further, this coupling member can be attached to the electric power tool main body while the electric power tool main body is fastened therein or removed therefrom. Further, a hanging member can be hooked to this coupling member.

Therefore, even if a part of the electric power tool provided for the hanging member breaks due to an impact against a floor when dropped, a fastening body of the coupling member can keep the state in which the electric power tool main body is fastened therein. Therefore, as a result of the hanging member can be kept being hooked to the coupling member, the hanging member can also be kept being held.

According to another aspect of the present disclosure, the opening/closing may be achieved by coupling via a hinge.

Therefore, a part of the coupling member can be smoothly opened/closed.

Further, according to another aspect of the present disclosure, the coupling member for the electric power tool includes one or more fastening body capable of fastening the electric power tool main body, and one or more attachment body openably/closably coupled to the fastening body via one or more hinge, so as to be attached to the electric power tool main body while the electric power tool main body is fastened in the one or more fastening body.

The configuration of the coupling member can therefore be simplified.

Further, according to another aspect of the present disclosure, the attachment bodies are provided so as to form a pair. Also, hook parts each having a through hole configured to allow a hanging member to be hooked are provided so as to form a pair.

The pair of the through holes of the hook parts are arranged to be adjacent to each other when the pair of attachment bodies are attached to the electric power tool main body, while the electric power tool main body is fastened in the one or more fastening body.

Therefore, when the hanging member is hooked to the coupling member through the both through holes, the coupling member can be kept being attached to the electric power tool main body even if, for example, a screw/screws for attaching the coupling member to the electric power tool main body is/are removed. Accordingly, the degree of measures for preventing the electric power tool from falling can be enhanced.

Further, according to another aspect of the present disclosure, the pair of the attachment bodies are attached to the electric power tool main body by fastening a screw/screws.

The coupling member can thus be easily attached to the electric power tool main body.

Further, according to another aspect of the present disclosure, engagement portions are formed on the pair of the attachment bodies. The engagement portions of the pair of attachment bodies engage with portions to-be-engaged formed in the electric power tool main body. This engagement occurs when the pair of attachment bodies are attached to the electric power tool main body, while the electric power tool main body is fastened in the one or more fastening body.

The applied load exerted between the electric power tool and the hanging member can be dispersed when, for example, the dropped electric power tool is suspended by the hook at the workplace via the handing member. Therefore, it is possible to prevent, for example, a concentration of the load being applied to the screws for attaching the coupling member to the electric power tool main body.

Further, according to another aspect of the present disclosure, a silencer member is fitted and inserted into the hinge.

This prevents abnormal noise from being generated when the one or more fastening body and the pair of attachment bodies are relatively rotated.

Further, according to another aspect of the present disclosure, the pair of fastening bodies of the coupling member of the electric power tool are coupled via the one or more hinge, such that the electric power tool main body can be fastened thereinto. A hook part configured to allow the hanging member to be hooked is integrally formed with at least one of the pair of the fastening bodies.

Therefore, the configuration of the coupling member can be simplified.

Further, according to another aspect of the present disclosure, the coupling member for the electric power tool is attached to a loop handle of the electric power tool.

Accordingly, the one or more fastening body of the coupling member can keep the electric power tool main body being fastened therein, even if the portion of the electric power tool previously provided for the hanging member breaks due to an impact against the floor from being dropped. It is thus possible to keep the hanging member being held to the coupling member and, as a consequence, allowing the hanging member to be kept being hooked to the tool.

DETAILED DESCRIPTION

Figure 1:
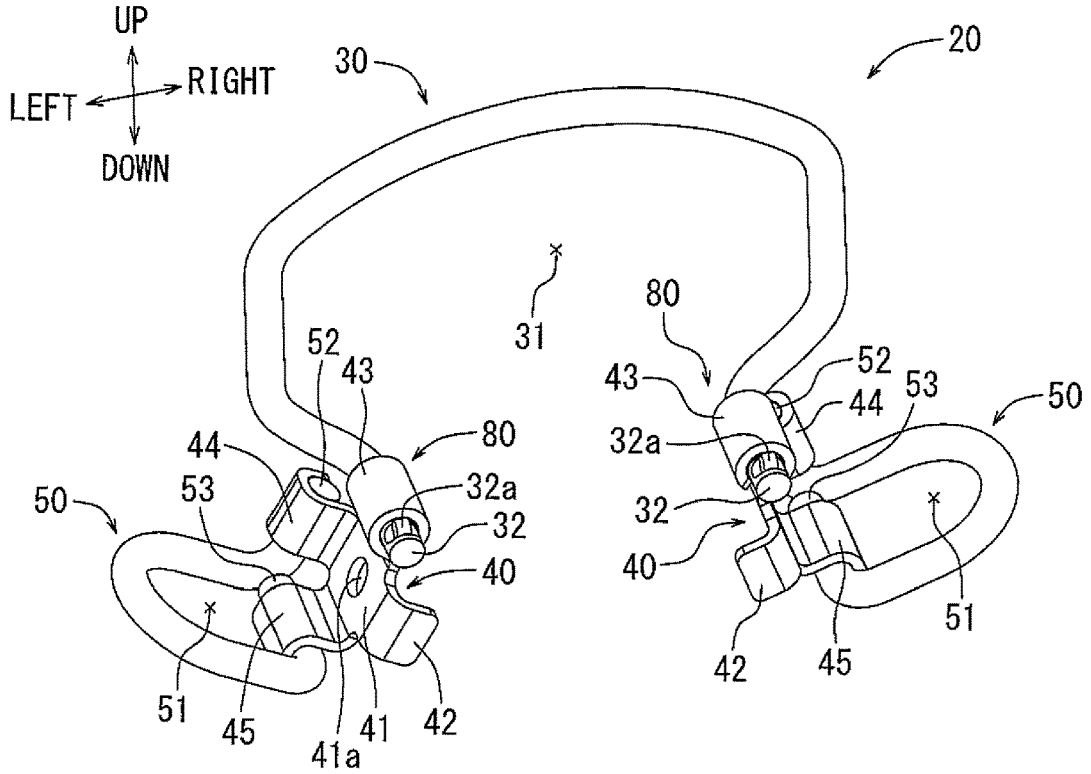
FIG. 1 is a perspective view of a coupling member according to a first embodiment, illustrating a pair of attachment bodies in an opened state.
Figure 2:
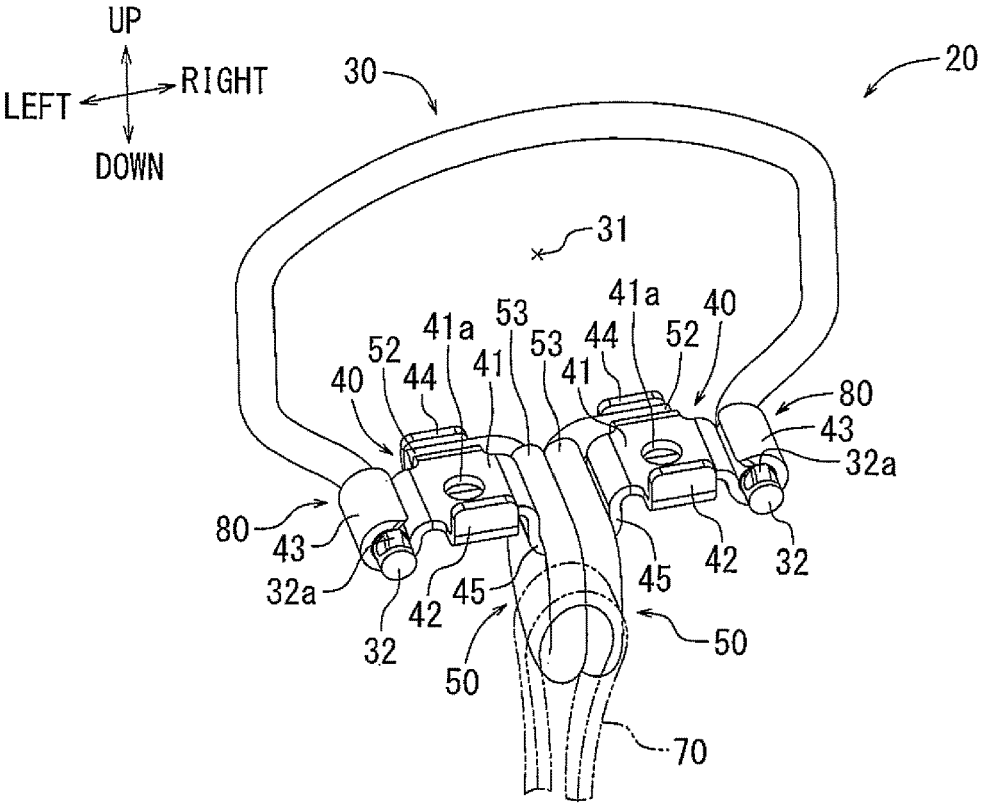
FIG. 2 illustrates the pair of the attachment bodies of FIG. 1 in a closed state.
Figure 3:
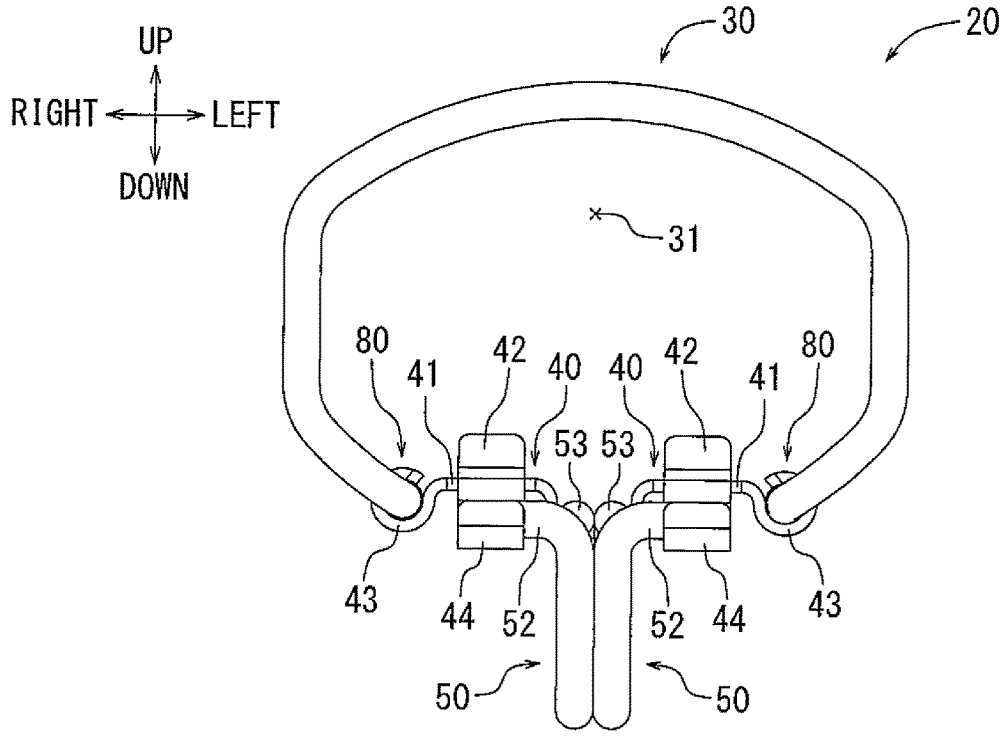
FIG. 3 is a front view of FIG. 2.
Figure 4:
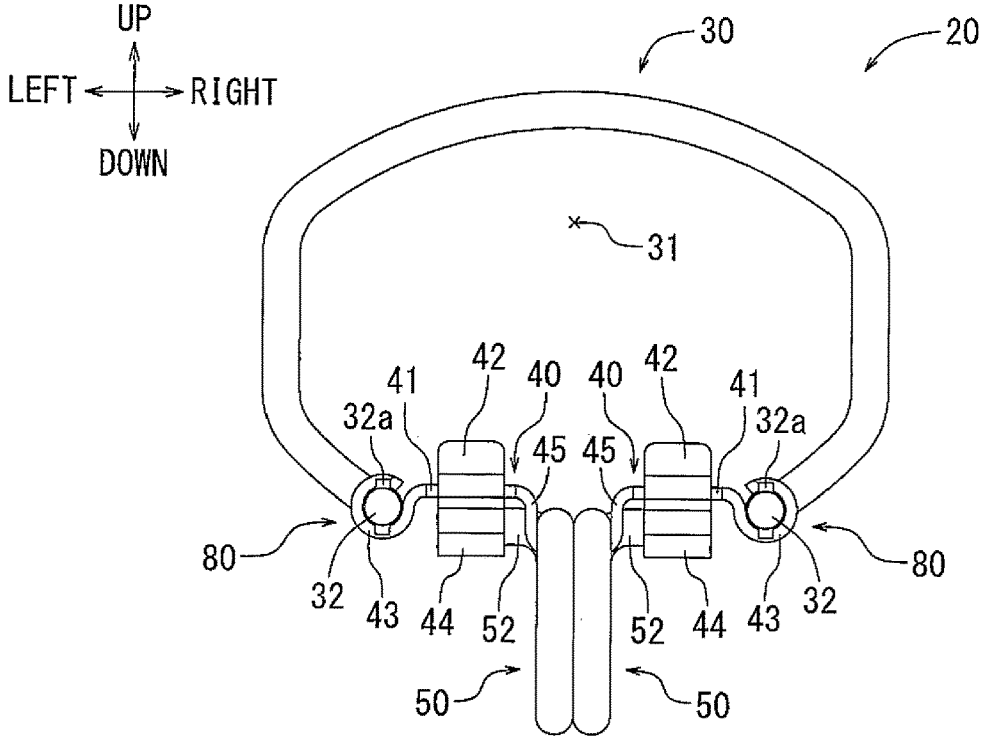
FIG. 4 is a rear view of FIG. 2.
Figure 5:
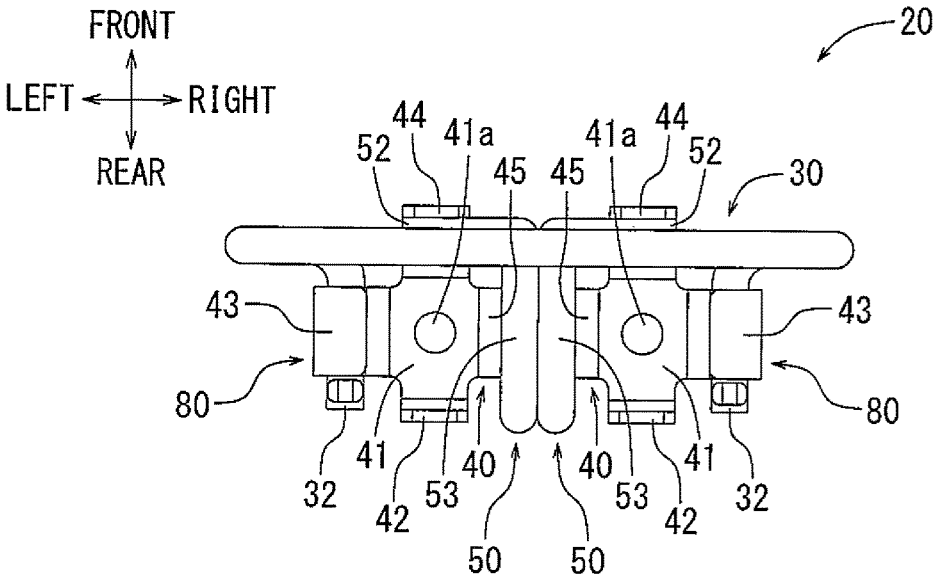
FIG. 5 is a plan view of FIG. 2.
Figure 6:
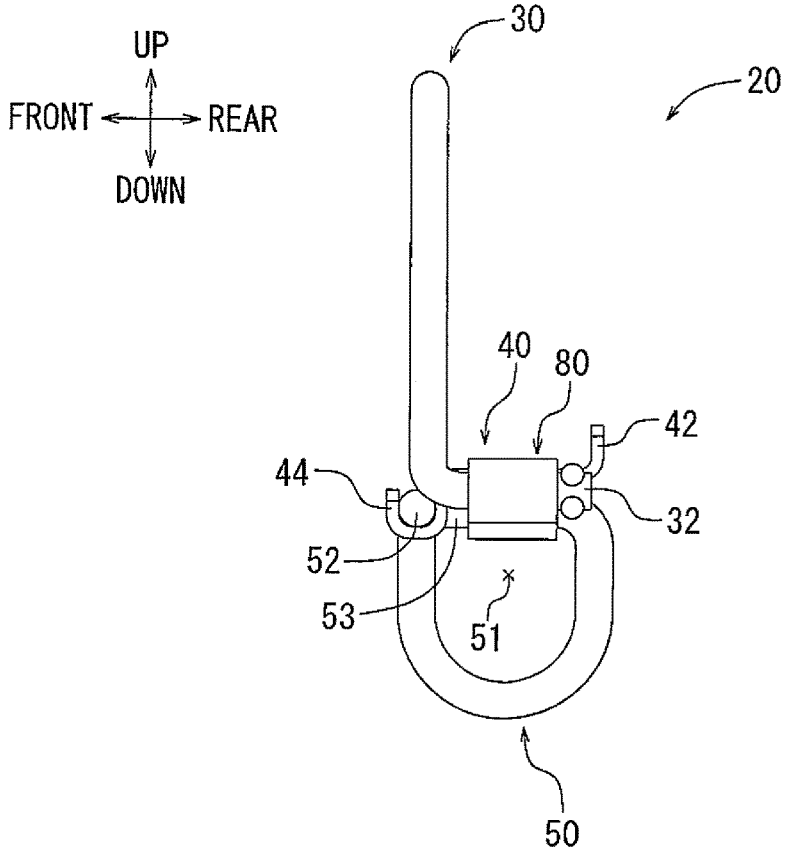
FIG. 6 is a side view of FIG. 2.
Figure 7:
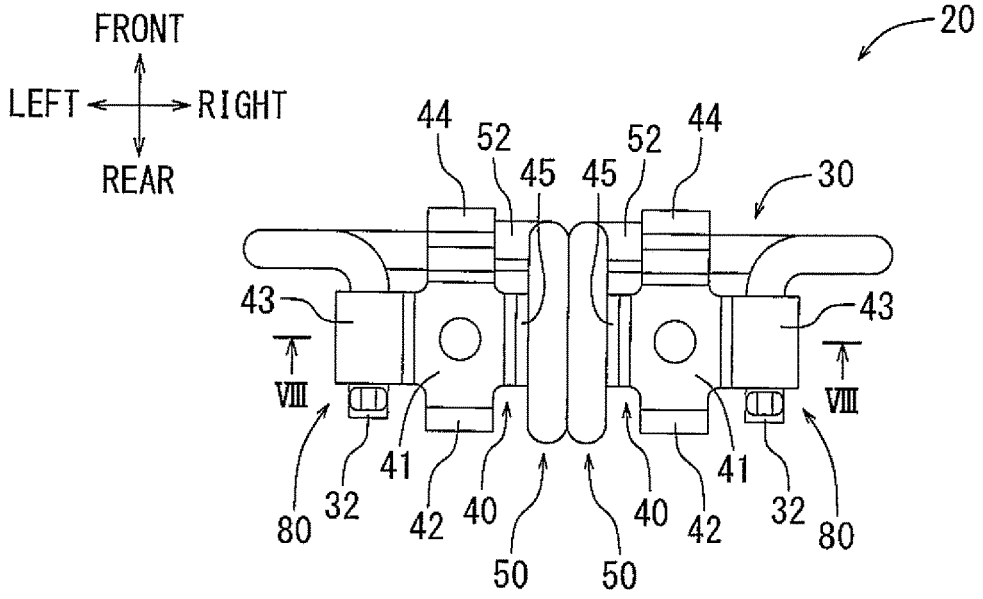
FIG. 7 is a bottom view of FIG. 2.
Figure 8:
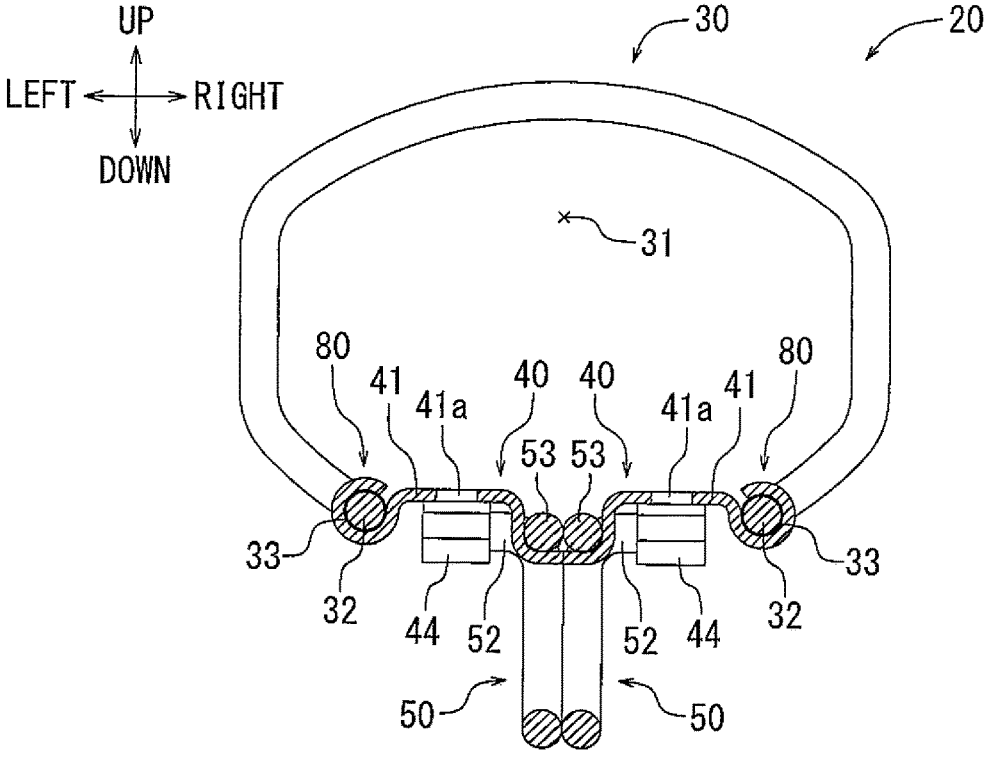
FIG. 8 is a cross-sectional view taken along line VIII-VIII in FIG. 7.
Figure 9:
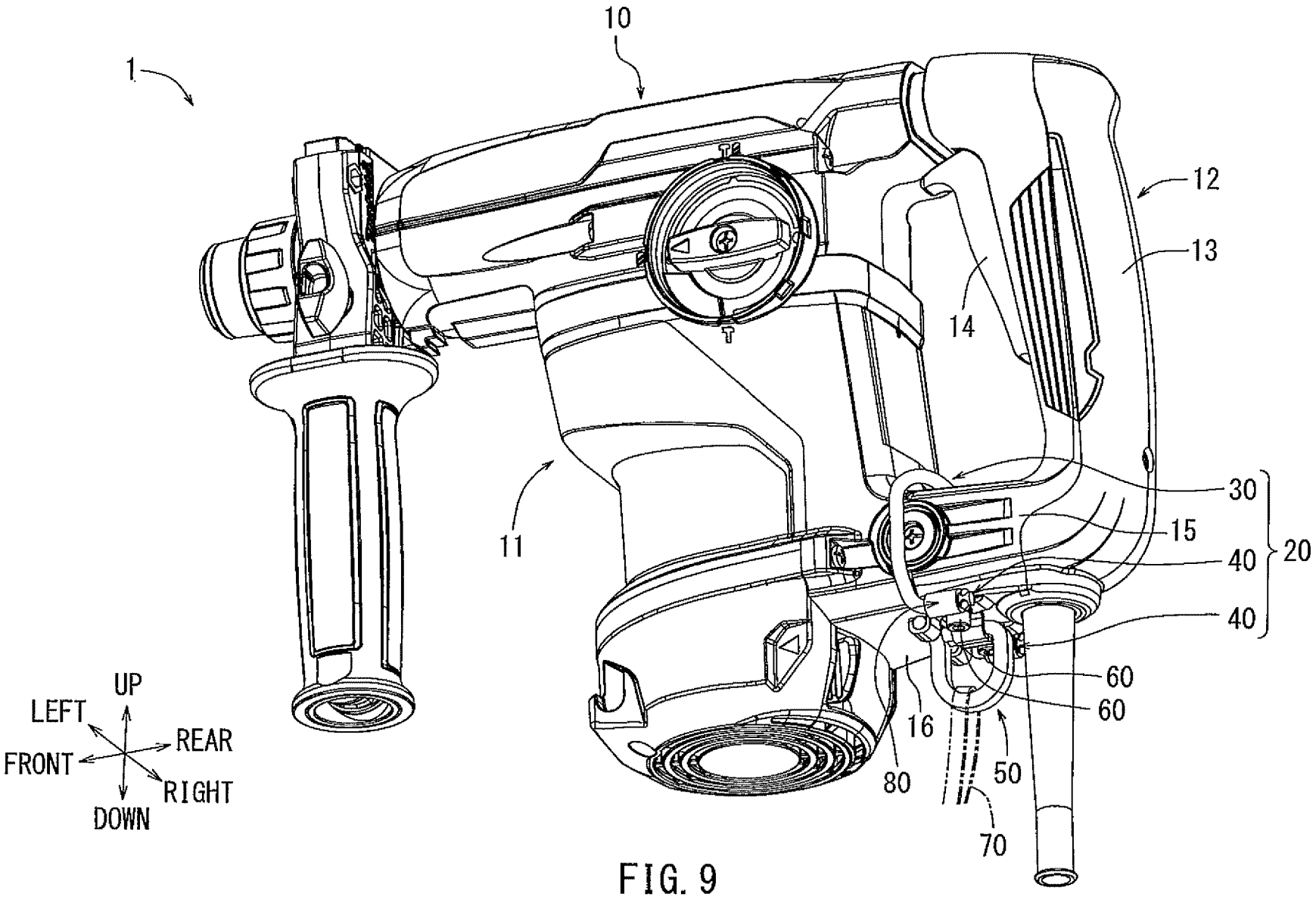
FIG. 9 is a perspective view illustrating a state in which the coupling member of FIG. 2 is attached to a loop handle of a hammer drill.
Figure 10:
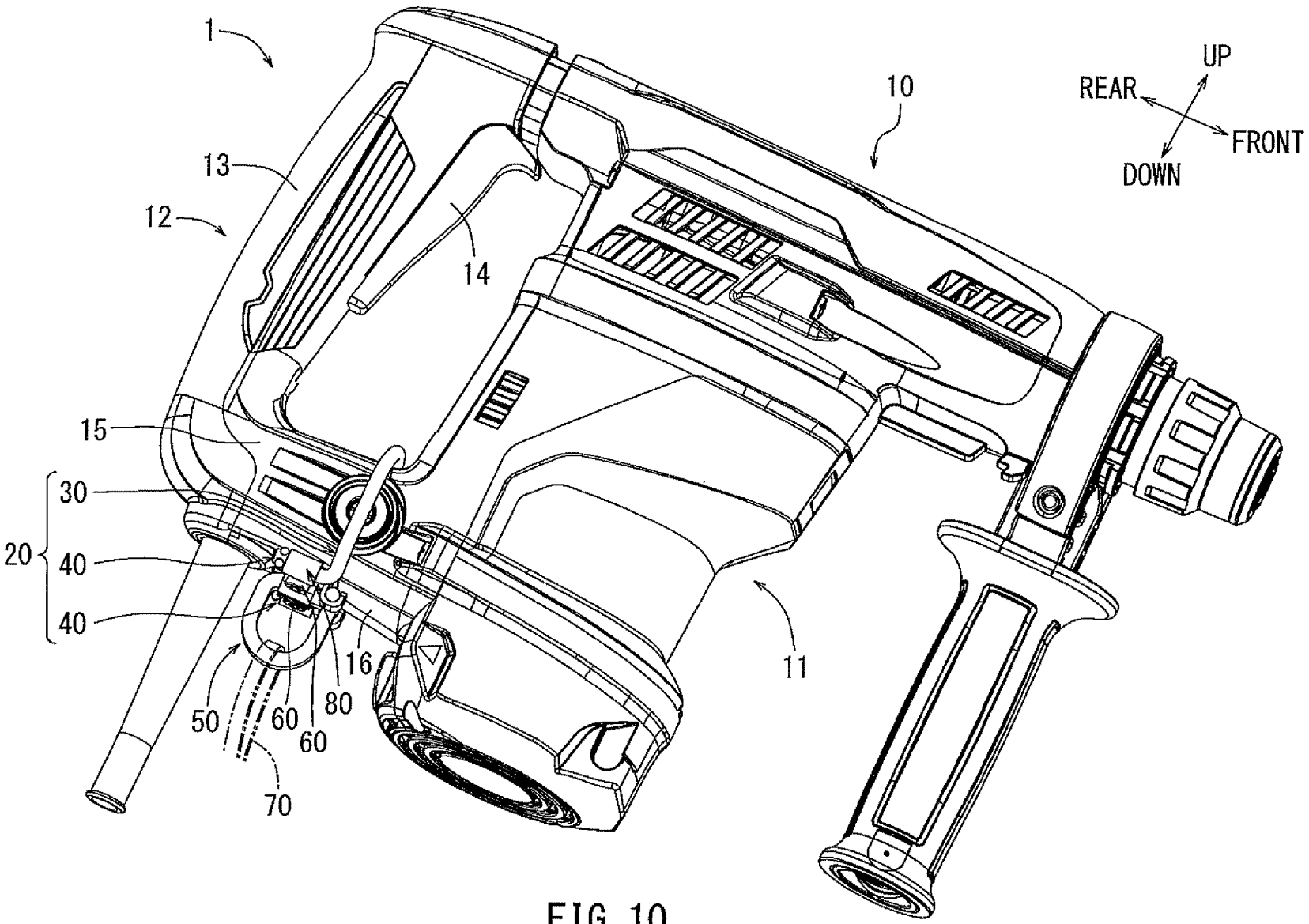
FIG. 10 is a perspective view as seen in a different orientation than FIG. 9.
Figure 11:
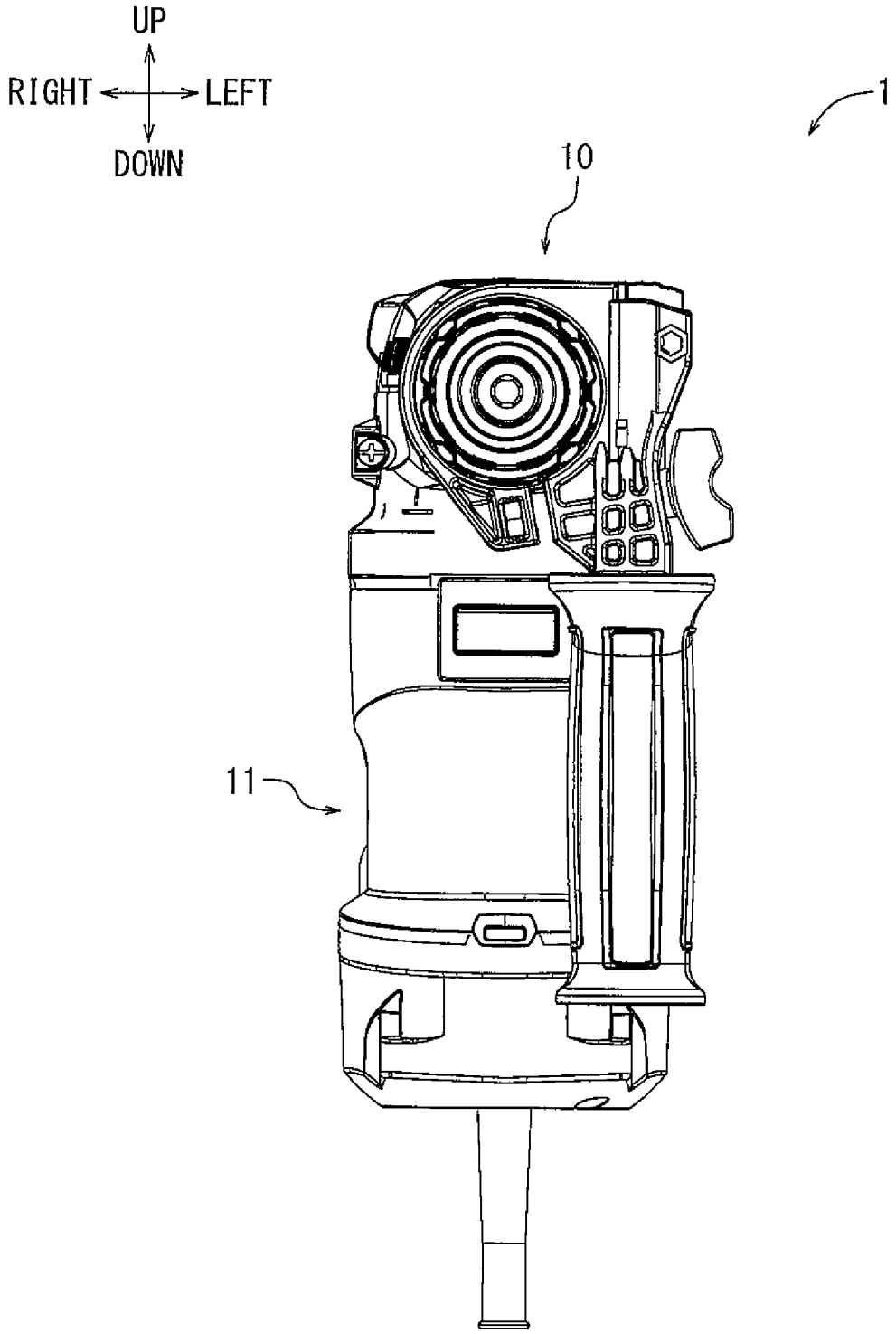
FIG. 11 is a front view of FIG. 9.
Figure 12:
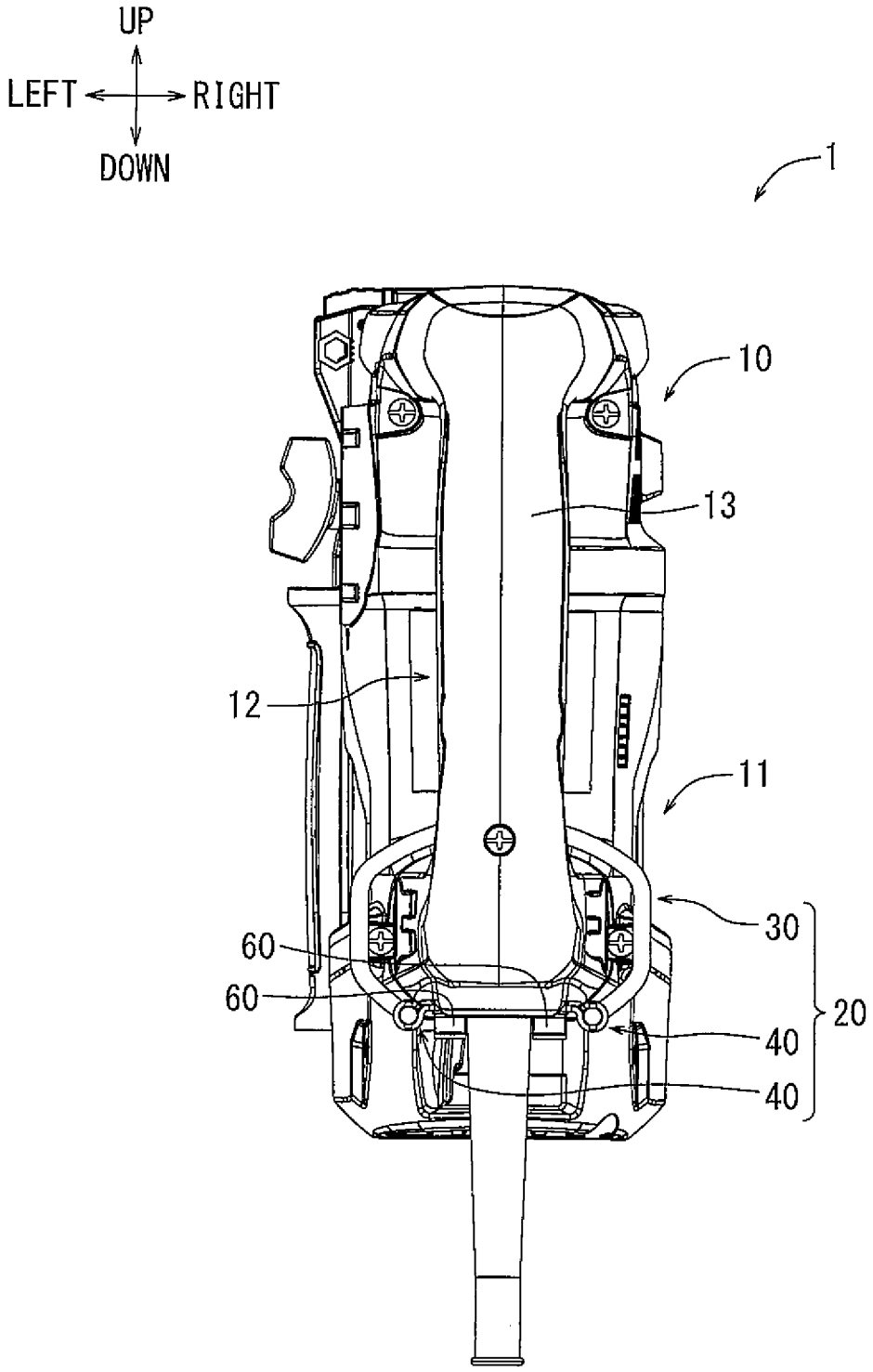
FIG. 12 is a rear view of FIG. 9.
Figure 13:
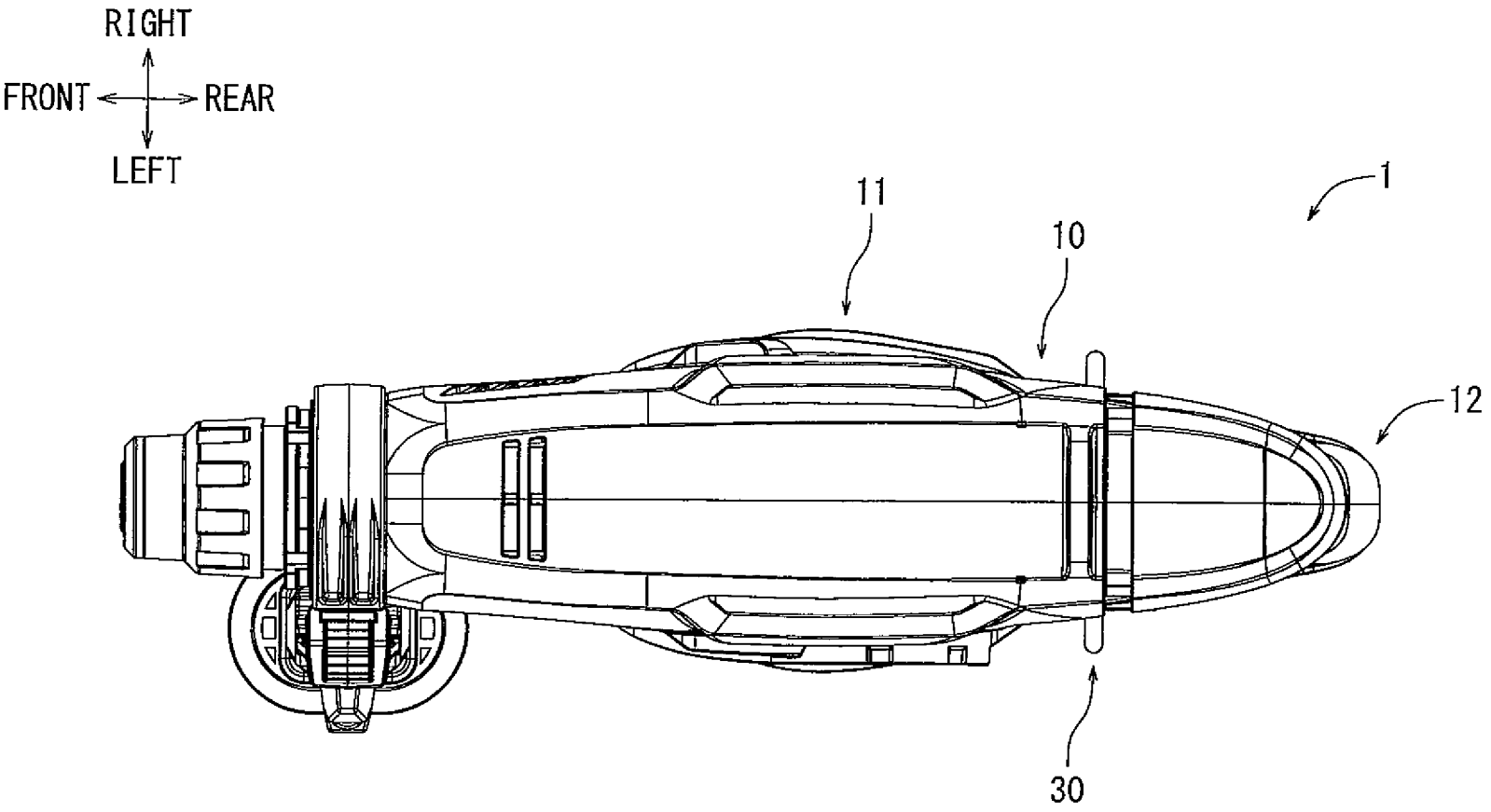
FIG. 13 is a plan view of FIG. 9.
Figure 14:
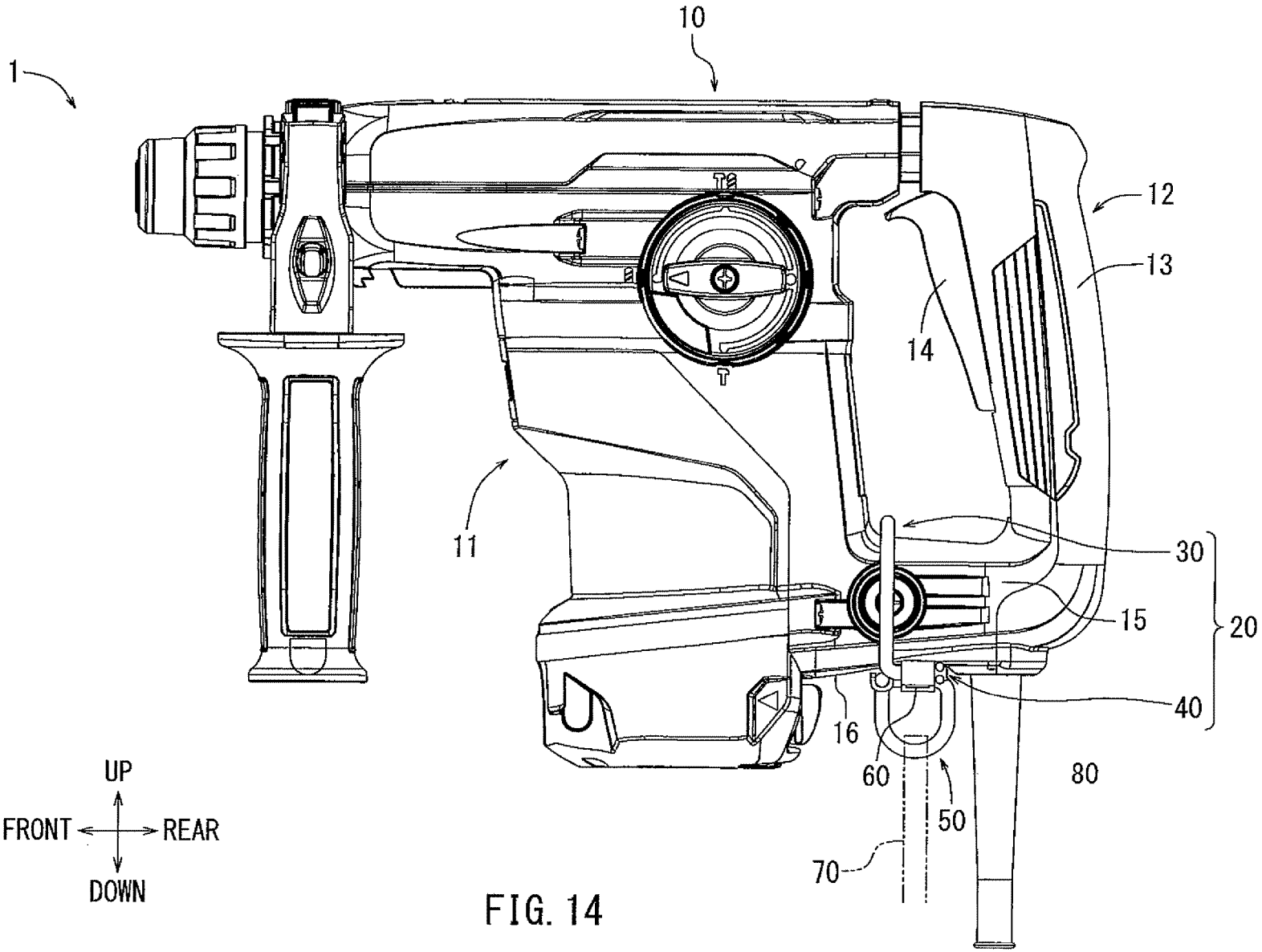
FIG. 14 is a side view of FIG. 9.
Figure 15:
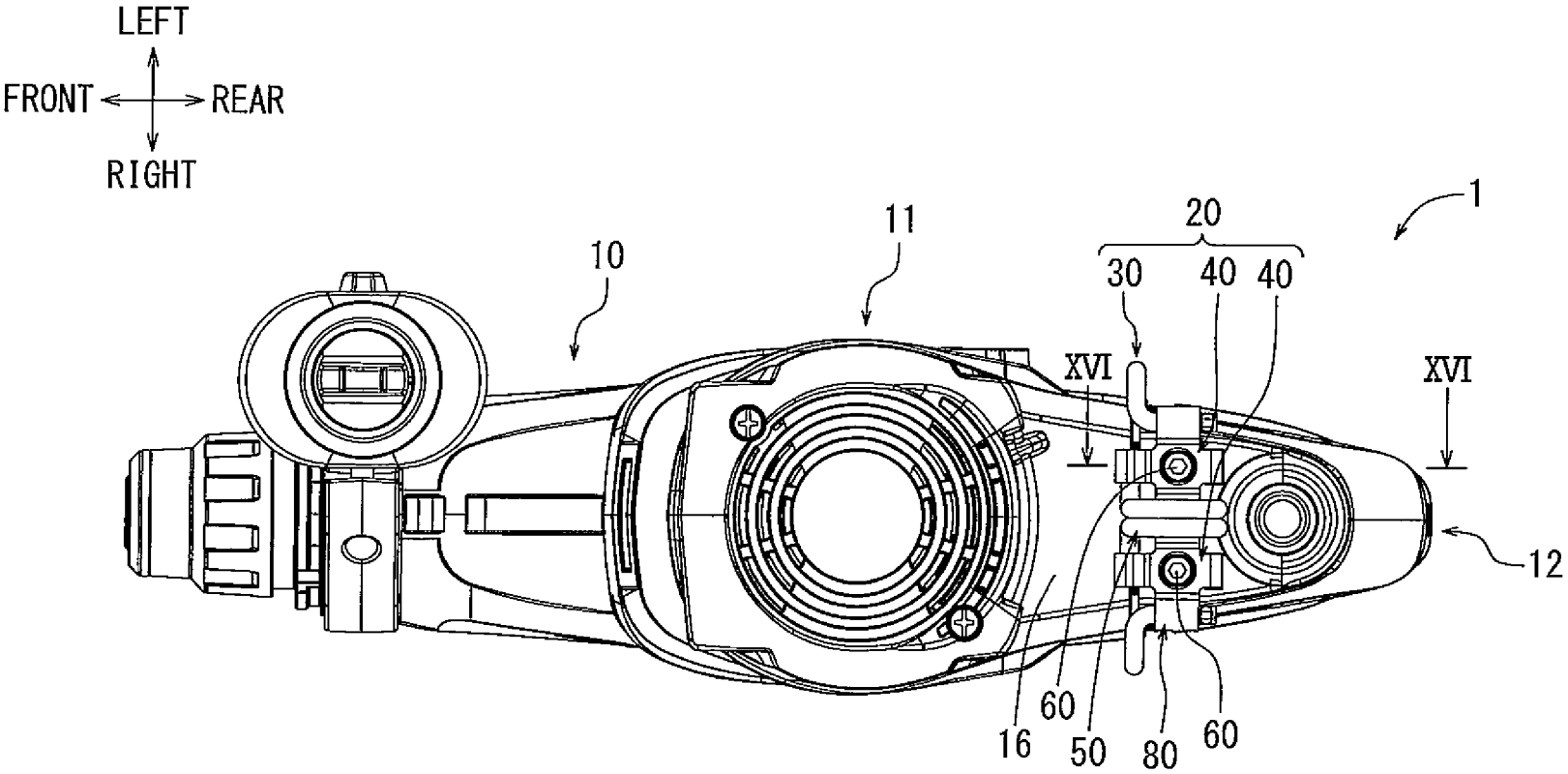
FIG. 15 is a bottom view of FIG. 9.

Hereinafter, embodiments for carrying out the present disclosure will be described with reference to drawings

First Embodiment

Firstly, a first embodiment of the present disclosure will be described with reference to FIG. 1 to FIG. 16. In the following description, a "hammer drill 1," a "loop handle 12," and a "strap 70" will be described respectively as an example of an "electric power tool," an "electric power tool main body," and a "hanging member." Further, in the following description, up, down, front, rear, left, and right indicate up, down, front, rear, left, and right directions as shown in the above-described figures. More specifically, the front direction indicates a front end direction of a hammer drill 1. Firstly, the hammer drill 1 and a coupling member 20 attached to the loop handle 12 of this hammer drill 1 will be described individually.

First of all, the hammer drill 1 will be described (see FIG. 9 to FIG. 16). This hammer drill 1 has an electric power tool main body mainly composed of a main body housing 10 defining an outer contour, a motor housing 11 in which a motor (not shown), with an output shaft (not shown) oriented upward, below the main body housing 10 is installed, and a loop handle 12 having a grip portion 13 attached on a rear side so as to extend over and between the main body housing 10 and the motor housing 11.

The hammer drill 1 has a percussive impact mechanism (not shown) for converting a rotational force of the output shaft of the motor to a percussive impact force for a drill bit (not shown). The hammer drill 1 also has a rotary mechanism (not shown) for converting the rotational force of the output shaft of the motor to a rotational force for the drill bit. A trigger 14 is attached to this loop handle 12, which is configured to turn an internal switch (not shown) ON when pulled by an operator.

Further, attachment holes 17 are formed on a bottom surface 16 of a lower part 15 of this loop handle 12, so as to form a pair on the left and right sides to allow later-described screws 60, which are used for attaching the coupling member 20, to be screwed thereinto. Further, recessed grooves 18 are formed on the bottom surface 16 of this loop handle 12, so as to form a pair on the left and right sides to allow respective first raised pieces 42 of left and right attachment bodies 40, which are used for attaching the coupling member 20, to be inserted (see FIG. 16).

Further, when an operator (not shown) pulls the trigger to operate while grasping the grip portion 13 of the loop handle 1, an electric signal (ON signal of the trigger 14) is input to a controller (not shown) incorporated to the motor housing 11. This allows the output shaft of the motor to rotate, so that the rotational force of the output shaft of this motor is converted to the percussive impact force for the drill bit via the percussive impact mechanism.

As a result, the percussive motion of the drill bit can be carried out. Simultaneously, the rotational force of the output shaft of this motor is converted to the rotational for the drill bit via the rotary mechanism. This allows the drill bit to carry out the rotational motion. Therefore, since the percussive impact force and the rotational force can be applied to the drill bit, drilling operation into, for example, a gypsum material or the like can be efficiently carried out. The hammer drill 1 is composed in this manner.

Hereinafter, a coupling member 20 will be described (see FIGS. 1 to 8). The coupling member 20 of this embodiment is mainly composed of a fastening body 30 and a pair of attachment bodies 40. More specifically, this coupling member 20 is primarily composed of three parts. This fastening body 30 may be formed by bending a metal wire member, so as to have a fastening space along the lower part 15 of the loop handle 12 of the hammer drill 1. Both ends 32 of this fastening body 30 are bent rearward along the axial direction (front/rear direction) of the fastening space 31. Retaining claws 32*a* for preventing hinges 80 (which includes second raised pieces 43 of the attachment body 40), which will be described later, from being removed are respectively formed on the both ends 32. The fastening body 30 may be composed in this manner.

Additionally, the attachment bodies 40 may be formed of two mirrored attachment bodies 40. Each of these attachment bodies 40 may be formed by bending a metal member, so as to have a base 41, which may be rectangular, and four raised pieces 42, 43, 44, 45 (first raised piece 42, second raised piece 43, third raised piece 44, and fourth raised piece 45) projecting from edges of four sides of the base 41. An insertion hole 41*a* is formed in each of these bases 41 to allow a screw 60 to be inserted.

This first raised piece 42 is formed so that it can be inserted into the recessed groove 18 in the loop handle 12 of the hammer drill 1. Further, this second raised piece 43 is hinge-coupled to the end 32 of the fastening body 30. Specifically, the attachment bodies 40 are coupled to the fastening body 30 via the hinges 80. One end 52 of the hook part 50 is fixed to this third raised piece 44 by welding. Further, the other end 53 of the hook part 50 is fixed to this fourth raised piece 45 by welding.

Since it is fixed in this way, the hook parts 50 are provided at the attachment bodies 40. These hook parts 50 may be formed by bending a metal wire member so as to each have a through holes 51 to which the strap 70 can be hooked. These hook parts 50 are arranged so that one through hole 51 is adjacent to the through hole 51 of the other hook part 50 when the coupling member 20 is attached to the loop handle 12 of the hammer drill 1 (see FIG. 2). The pair of attachment bodies may be configured in this manner.

The pair of the attachment bodies 40 configured in this manner are coupled to the fastening body 30 via the hinges 80, as already described. The pair of the attachment bodies 40 can thus be rotated relative to the fastening body 30 about axes of both ends 32 of the fastening body 30 (see FIGS. 1 and 2). Resin sleeves 33 are fittedly inserted between both ends 32 of the fastening body 30 and the respective second raised pieces 43 of the pair of attachment bodies 40 when coupled via these hinges 80 (see FIG. 8). The coupling member 20 may be configured in this manner.

Next, steps for hooking the strap 70 to the loop handle 12 of the hammer drill 1 will be described. Firstly, the pair of the attachment bodies 40 are rotated (opened) such that the fastening space 31 of the coupling member 20 is opened (see FIG. 1). Next, the lower part 15 of the loop handle 12 of the hammer drill 1 is placed into the fastening space 31 of the coupling member 20. Next, the pair of the attachment bodies 40 are rotated (closed), such that the fastening space 31 of the coupling member 20 containing the lower part 15 of the loop handle 12 fastened therein is closed (see FIG. 2).

Figure 16:
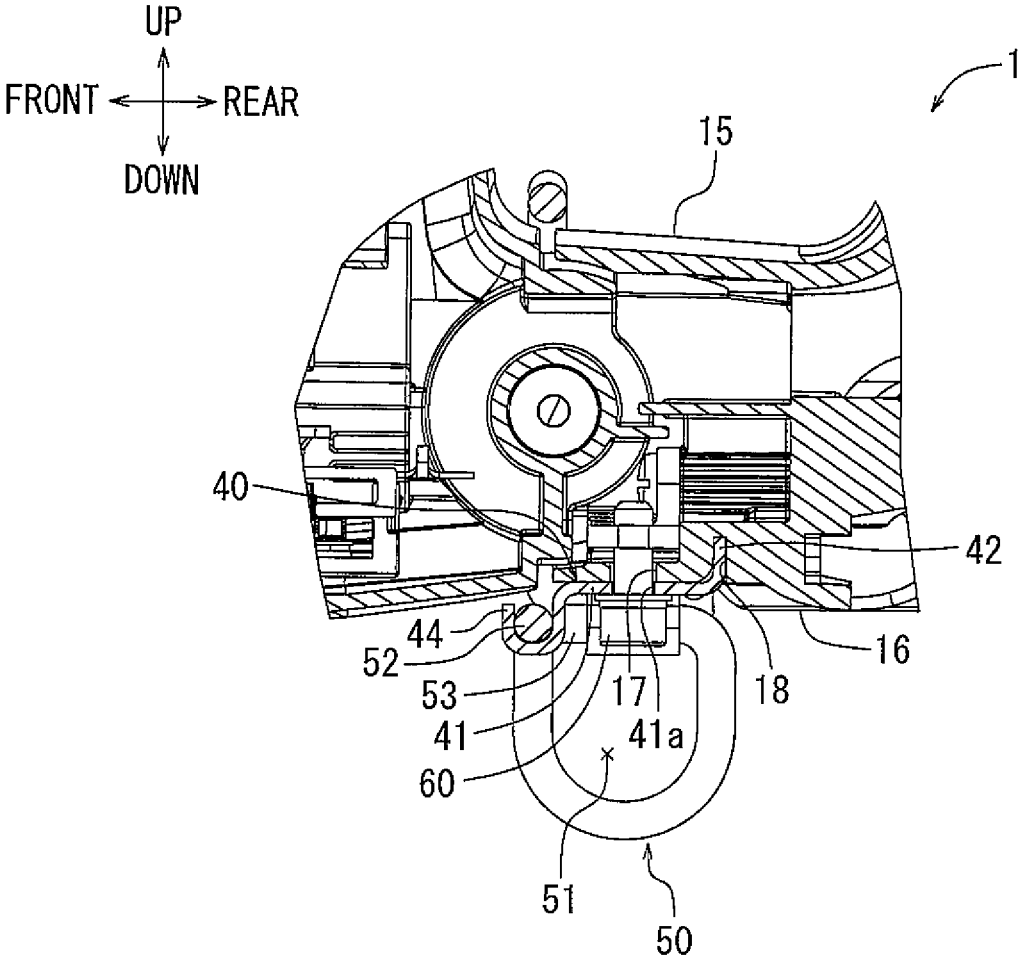
FIG. 16 is a cross sectional view taken along line XVI-XVI in FIG. 15.
Figure 17:
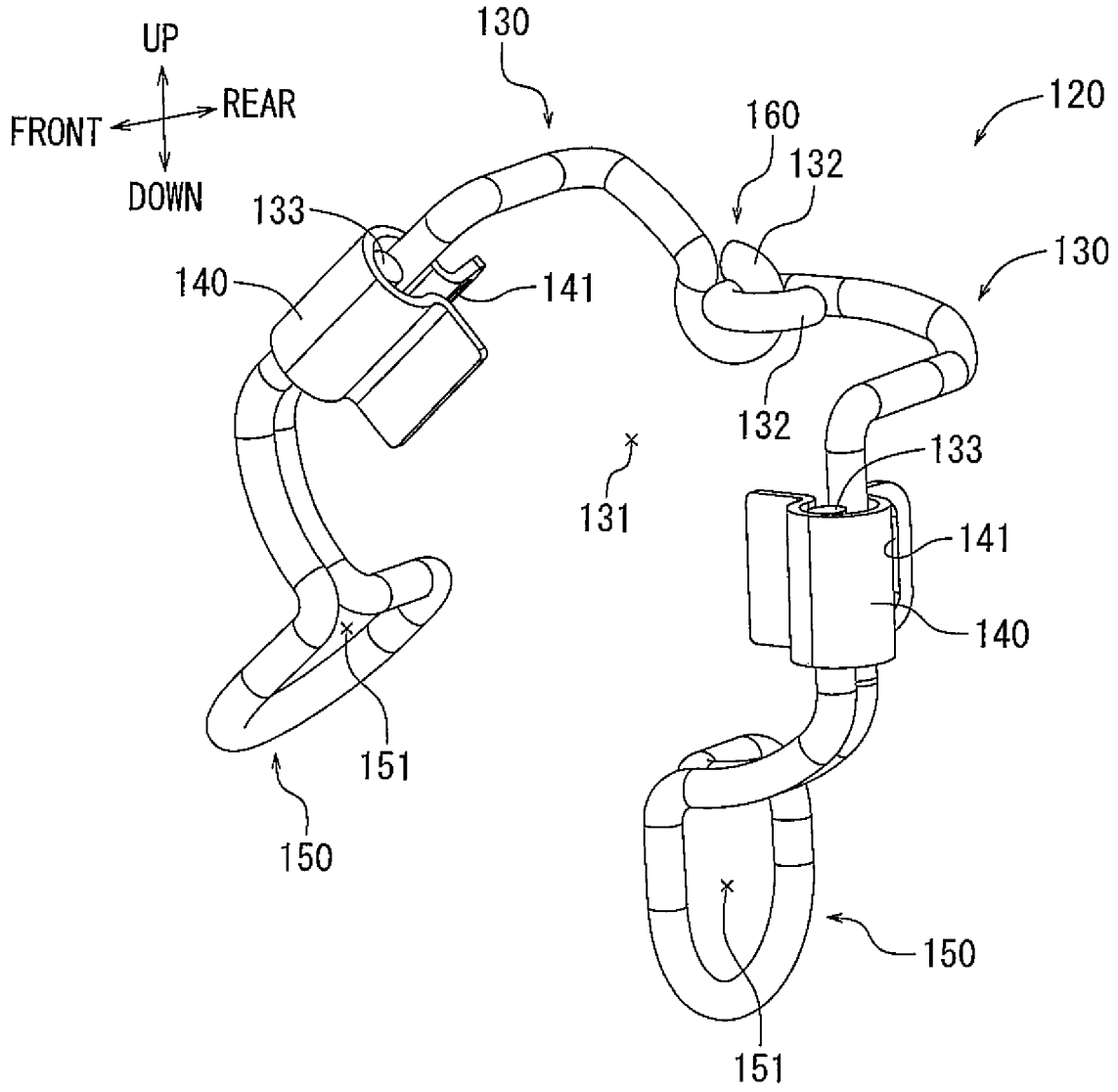
FIG. 17 is a perspective view of a coupling member according to a second embodiment, illustrating a pair of fastening bodies in an opened state.
Figure 18:
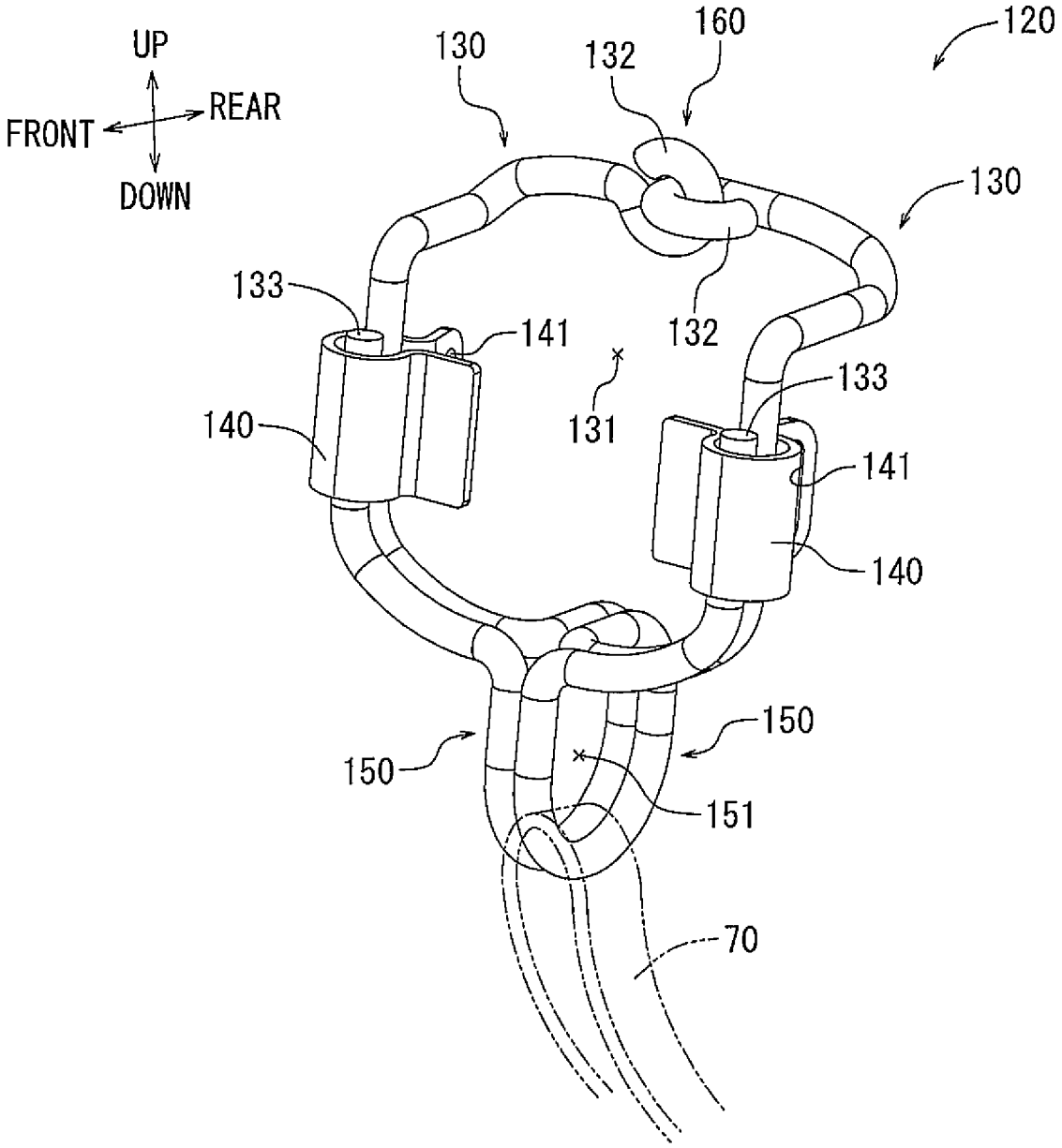
FIG. 18 illustrates the pair of fastening bodies in a closed state.
Figure 19:
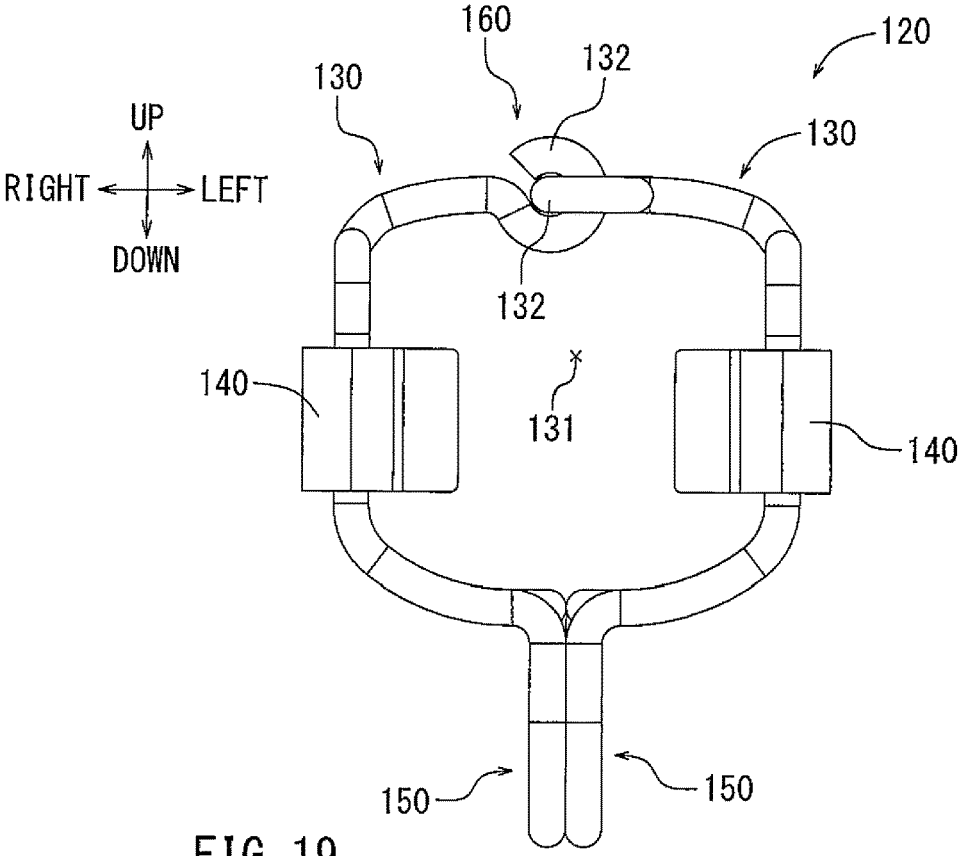
FIG. 19 is a front view of FIG. 18.
Figure 20:
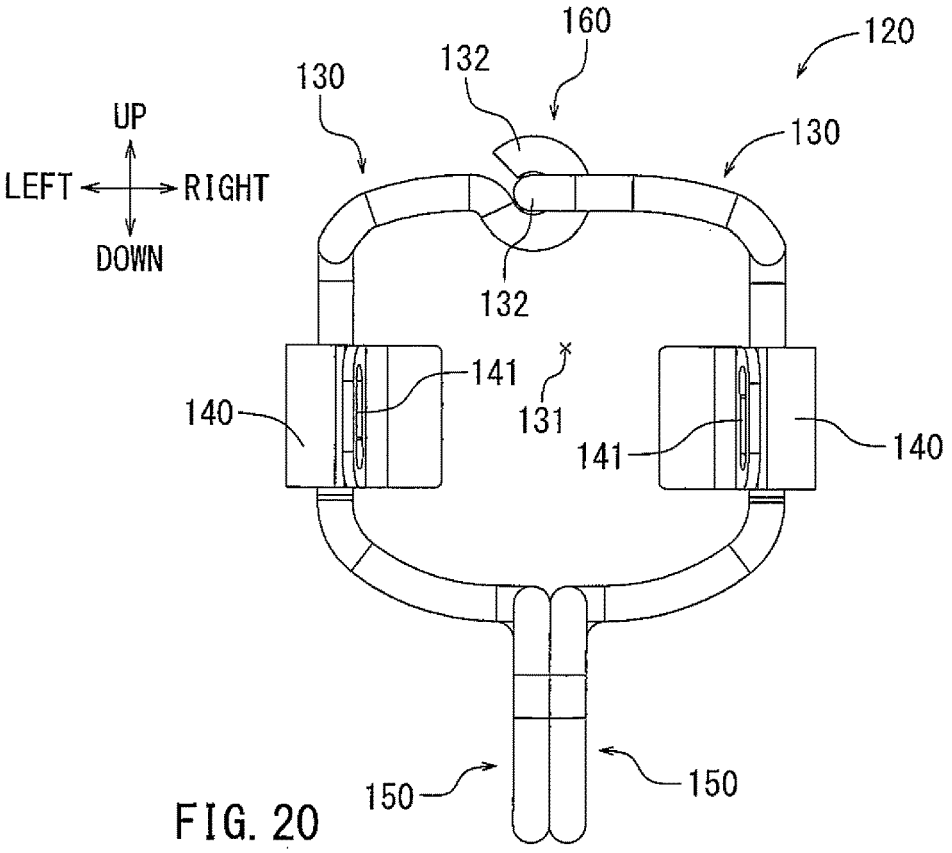
FIG. 20 is a rear view of FIG. 18.
Figure 21:
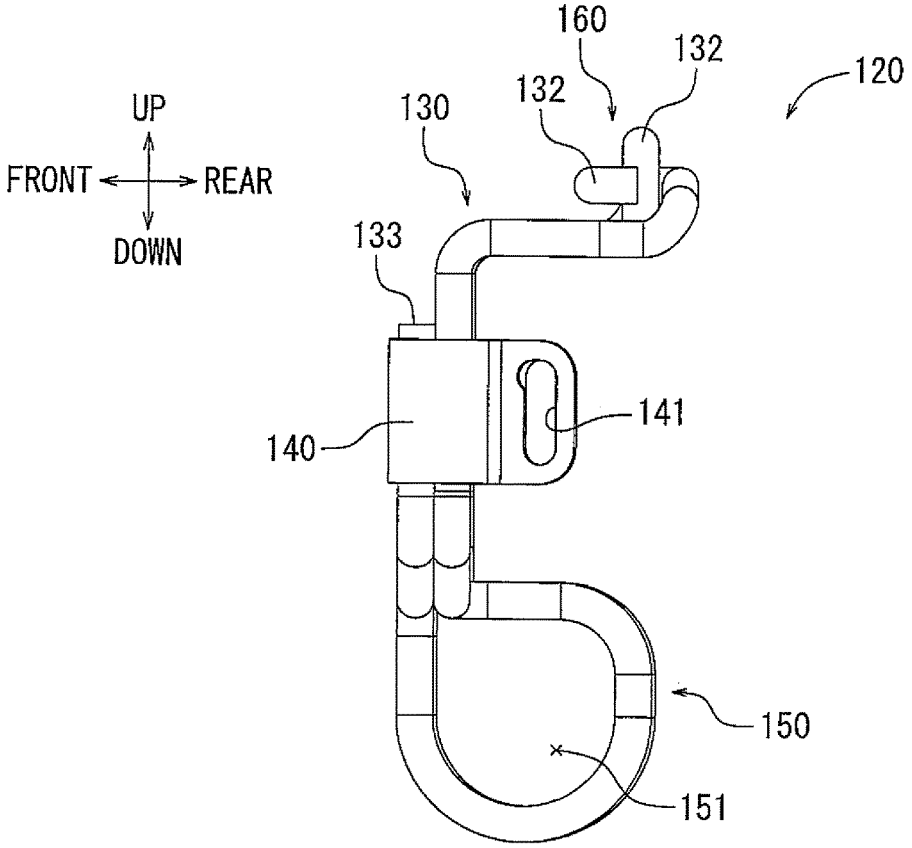
FIG. 21 is a side view of FIG. 18.
Figure 22:
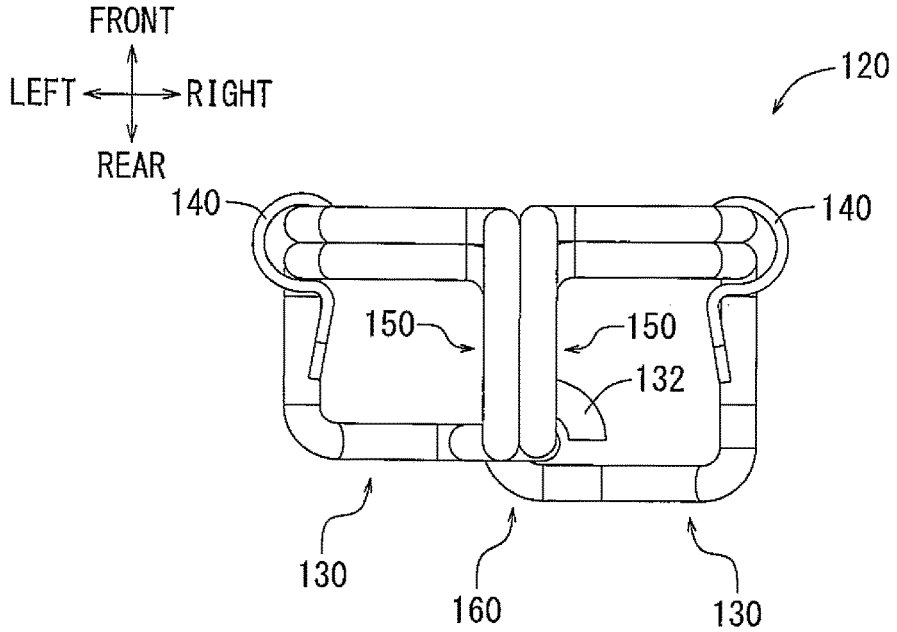
FIG. 22 is a bottom view of FIG. 18.

The respective first raised pieces 42 of the rotated pair of the attachment bodies 40 are then inserted into the respective recessed grooves 18 of the loop handle 12 (see FIG. 16). Next, screws 60 are respectively inserted into each insertion hole 14*a* of both attachment bodies 40 of the coupling member 20, such that these inserted screws 60 are screwed into the each of the attachment holes 17 of the loop handle 12. This allows the pair of attachment bodies 40 of the coupling member 20 to be attached to the loop handle 12 of the hammer drill 1. At this time, the respective first raised pieces 42 of the pair of attachment bodies 40 are inserted into the respective recessed grooves 18 of the loop handle 12.

In this way, the coupling member 20 may be attached to the loop handle 12 of the hammer drill 1. A coupling member 20 attached in this way is arranged such that each of the through holes 51 of the pair of hook parts 50 are adjacent to each other, as already described. Finally, the strap 70 is hooked into each of the through holes 51 of the coupling member 20 (see FIGS. 9, 10, and 14). This allows the strap 70 to be hooked (held) to the loop handle 12 of the hammer drill 1. Further, to remove the hooked strap 70, the above-mentioned steps can be performed in the opposite sequences.

The coupling member 20 according to the first embodiment of the present disclosure may be configured as described above. According to this configuration, the coupling member 20 can be fastened to the loop handle 12 of the hammer drill 1 by opening/closing a part of the coupling member 20. Further, the coupling member 20 can be attached to and removed from the loop handle 12, with the loop handle 12 being fastened therein. Further, the strap 70 can be hooked to the coupling member 20 attached to the loop handle 12. Therefore, even when the loop handle 12 (a holding portion for holding the strap 70) of the hammer drill 1 breaks due to, for instance, an impact against a floor (not shown) by being dropped, the coupling member 20 can maintain a state in which the loop handle 12 is fastened therein. Since the strap 70 is also kept hooked to the coupling member 20, as a result, this strap 70 can also be kept held (hooked) to the tool.

With this configuration, a part of the coupling member 20 can be opened/closed via the hinges 80. The part of the coupling member 20 can therefore be smoothly opened/closed, for instance without the need to substantially bend the fastening body 30.

Further, according to this configuration, the coupling member 20 includes a fastening body 30 into which the loop handle 12 of the hammer drill 1 is fastened, and a pair of the attachment bodies 40 openably/closably coupled to the fastening body 30 via the hinges 80. The coupling member 20 is configured so as to be attached to the loop handle 12, while the loop handle 12 is fastened in the fastening body 30. The configuration of the coupling member 20 can therefore be simplified.

Further, according to this configuration, the hook parts 50 are configured by bending metal wire members and are provided in a pair so as to have through holes 51 through which the strap 70 can be hooked. These hook parts 50 are arranged such that one through hole 51 is adjacent to the through hole 51 of the other hook part 50, when the coupling member 20 is attached to the loop handle 12 of the hammer drill 1. Therefore, when the strap 70 is inserted through both insertion holes 51, so as to be hooked to the coupling member 20, the attached state of the coupling member 20 to the loop handle 12 can be maintained even if, for example, the screw(s) 60 for attaching the coupling member 20 to the loop handle 12 is/are removed. As a result, the degree of measures for preventing the hammer drill 1 from falling can be enhanced.

Further, according to this configuration, the pair of attachment bodies 40 are attached to the loop handle 12 by tightening the screws 60. Therefore, the pair of attachment bodies 40 can be easily attached to the loop handle 12. Accordingly, the coupling member 20 can be easily attached to the loop handle 12.

Further, according to this configuration, the first raised pieces 42 are formed as part of the pair of the attachment bodies 40. When the pair of the attachment bodies 40 of the coupling member 20 are attached to the loop handle 12 of the hammer drill 1, the respective first raised pieces 42 of the pair of the attachment bodies 40 are inserted into the respective recessed grooves 18 of the loop handle 12. Therefore, when the dropped hammer drill 1 is suspended by, for example, the hook at workplace, via the strap 70, the load exerted between the hammer drill 1 and the strap 70 can be dispersed. It is thus possible to prevent a concentration of the load being applied to the screws 60.

Further, according to this configuration, the resin sleeves 33 are fittedly inserted between both ends 32 of the fastening body 30 and the respective second raised pieces 43 of the pair of the attachment bodies 40 when coupled via the hinges 80. It is thus possible to prevent abnormal noise from being generated, even when the fastening body 30 is rotated relative to the pair of the attachment bodies 40.

Second Embodiment

Hereinafter, a second embodiment of the present disclosure will be described with reference to FIGS. 17 to 22. The coupling member 120 of the second embodiment is an embodiment carried out with a more simple configuration (embodiment carried out with two parts instead of three parts) compared with the coupling member 20 of the first embodiment, which has already been described.

The coupling member 120 of the second embodiment is mainly composed of a pair of fastening bodies 130 (two fastening bodies 130 in a pair). More specifically, this coupling member 120 is composed of two parts. Each fastening body 130 may be formed by bending a metal wire member, such that a fastening space 131 for the lower part 15 of the loop handle 12 of the hammer drill 1 is formed when respective one ends 132 are hooked to each other, as will be described later.

One end 132 of the fastening body 130 is bent into a hook-shape, such that one end 132 of the other fastening body 130 can be hooked (such that the one end 132 of each can be hooked to each other). Hook parts 150 with through holes 151, which correspond to the hook parts 50 with the through holes 51 as described in the first embodiment, are bent and formed at the midway of each fastening body 130. Further, attachment bodies 140, each having a through hole 141 for allowing a screw (not shown) to be inserted, are fixed to the other ends 133 of this fastening body 130 by welding.

The pair of fastening bodies 130 may be configured in this manner. The pair of fastening bodies 130 configured in this manner are coupled such that the respective one ends 132 are coupled so as to be hooked to each other. When coupled in this manner, the pair of the fastening bodies 130 are coupled via a hinge 160, so as to be rotatable about the axis of the fastening space 131 in an axial direction (forward/rearward direction). This allows the pair of fastening bodies 130 to rotate relatively about the axis of this hinge 160 (see FIGS. 17 and 18). The coupling member 120 may be configured in this manner.

Next, steps for hooking the strap 70 to the loop handle 12 of the hammer drill 1 will be described. Firstly, the pair of the fastening bodies 130 are rotated (opened) such that the fastening space 131 of the coupling member 120 is opened (see FIG. 17). Next, the lower part 15 of the loop handle 12 of the hammer drill 1 is placed in the fastening space 131 of the coupling member 120. Next, the pair of the fastening bodies 130 are rotated (closed), such that the fastening space 131 of the coupling member 120 with the lower part 15 of the loop handle 12 fastened therein is closed (see FIG. 18).

Next, screws are respectively inserted into each of the insertion holes 141 formed in both attachment bodies 140 of the coupling member 120, such that these inserted screws are screwed into each of the attachment holes (not shown) of the loop handle 12. Consequently, both attachment bodies 140 of the coupling member 120 are fixed to the loop handle 12 of the hammer drill 1. The coupling member 120 may be attached to the loop handle 12 of the hammer drill 1 in this way.

The coupling member 120 attached in this way is arranged such that each of the through holes 151 of both hook parts 150 is arranged to be adjacent to one other, similar to that described for the first embodiment. Finally, the strap 70 is hooked into each of the through holes 151 of the coupling member 120. This allows the strap 70 to be hooked to the loop handle 12 of the hammer drill 1. Further, to remove the hooked strap 70, the above-mentioned steps can be performed in the opposite sequences.

The coupling member 120 according to the second embodiment of the present disclosure may be configured as described above. According to this configuration, it is possible to obtain the same action effect as that of the coupling member 20 according to the first embodiment.

Third Embodiment

Next, a third embodiment of the present disclosure will be described with reference to FIGS. 23 to 29. A coupling member 220 to be attached to the loop handle 12 of the hammer drill 1 of the third embodiment is carried out with a rigid structure, compared to the coupling member 120 of the already described second embodiment.

The coupling member 220 of the third embodiment is mainly composed of a fastening body 230 and a fixture body 270. More specifically, this coupling member 220 may be composed of two parts. This fastening body 230 may be formed by bending a metal wire member, so as to have a fastening space 231 for the lower part 15 of the loop handle 12 of the hammer drill 1. Both ends 232, 233 of this fastening body 230 are bent rearward along the axial direction (frontward/rearward direction) of the fastening space 231.

A retaining claw **232*a* for preventing a hinge 280 (which comprises a bent piece 272*a* of the fixture body 270), which will be described later, from being removed is formed on this one end 232. A hook part 250 with a through hole 251, corresponding to the hook part 50 with the through hole 51 as described in the first embodiment, is bent and formed at the midway of this fastening body 230, at a position closer to the other end 233. An attachment body 240 having a base 241, a first raised piece 242 formed of a right edge of the base 241, and a pair of second raised pieces 243 formed of a rear edge of the base are formed on the side of the other end 233 of this fastening body 230**.

This base 241 is formed with a pair of insertion holes 241*a* into which screws 260, which will be described later, can be inserted, and a recess 241*b* positioned between the pair of the insertion holes 241*a*. Further, the first raised piece 242 is formed with an insertion hole (not shown), into which a later described screw 261 can be inserted. A nut 242*a* can be screwed onto the screw 261 inserted into the insertion hole.

Further, the pair of the second raised pieces 243 are formed so as to correspond to each of the first raised pieces 42 of the pair of the attachment bodies 40 of the first embodiment. The first raised piece 242 of the third embodiment and the recess 241*b* in the base 241 of the attachment bodies 240 configured in this manner are fixed in place by welding, so as to extend over the end 233 of the fastening body 230 and the hook part 250. The fixture body 270 is made of a metal component capable of closing both ends 232, 233 of the fastening body 230.

An insertion hole (not shown) to allow the screw 261, which can be fixed by the nut 242*a* of the attachment body 240, to be inserted is formed in one end 271 of the fixture 270. Further, a bent piece 272*a* is formed at the other end 272 of the fixture body 270. This bent piece 272*a* is hinge-coupled to the one end 232 of the fastening body 230. In other words, the fixture body 270 is coupled to the fastening body 230 via the hinge 280.

Figure 23:
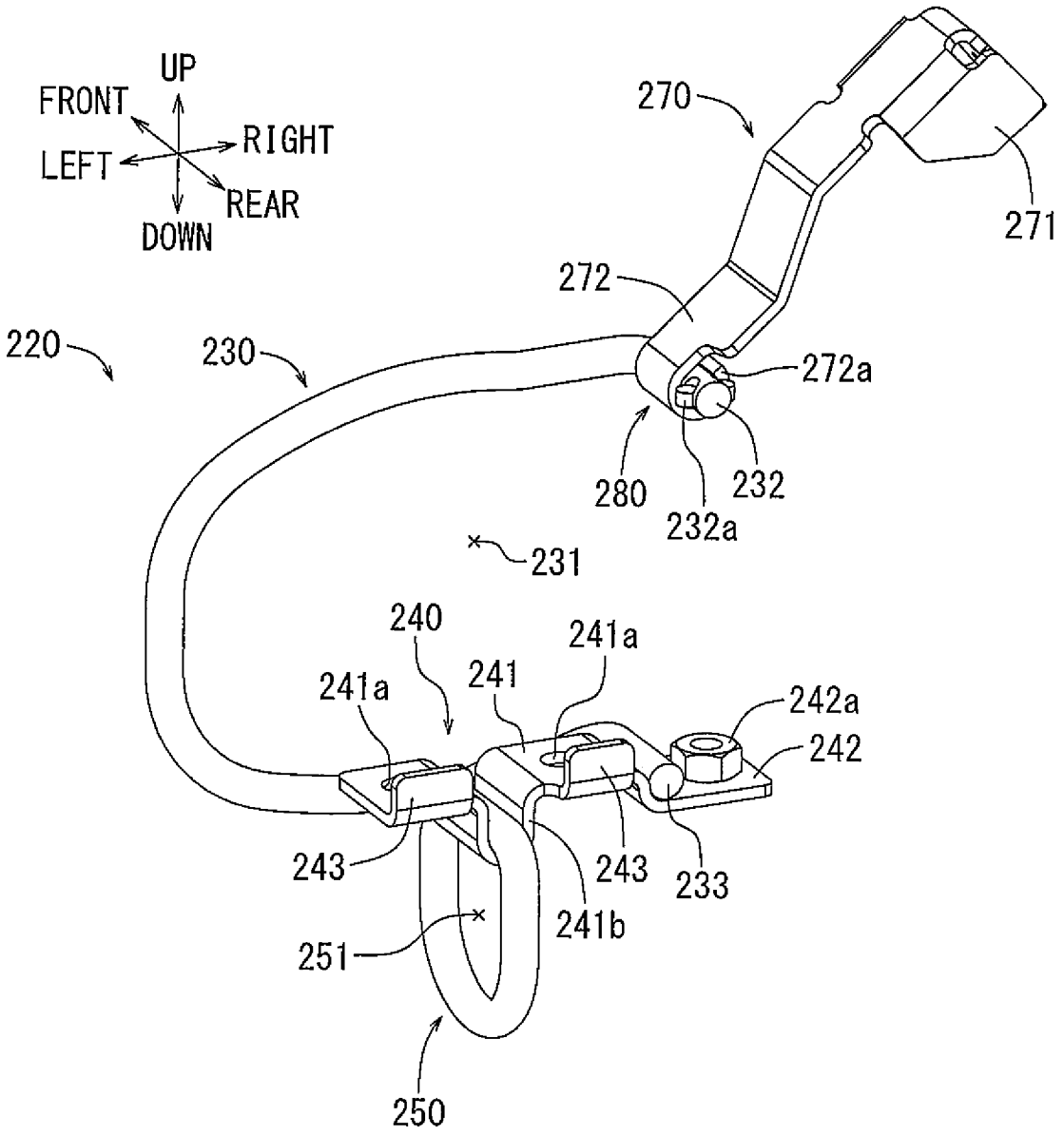
FIG. 23 is a perspective view of a coupling member according to a third embodiment illustrating a fixture body in an opened state.
Figure 24:
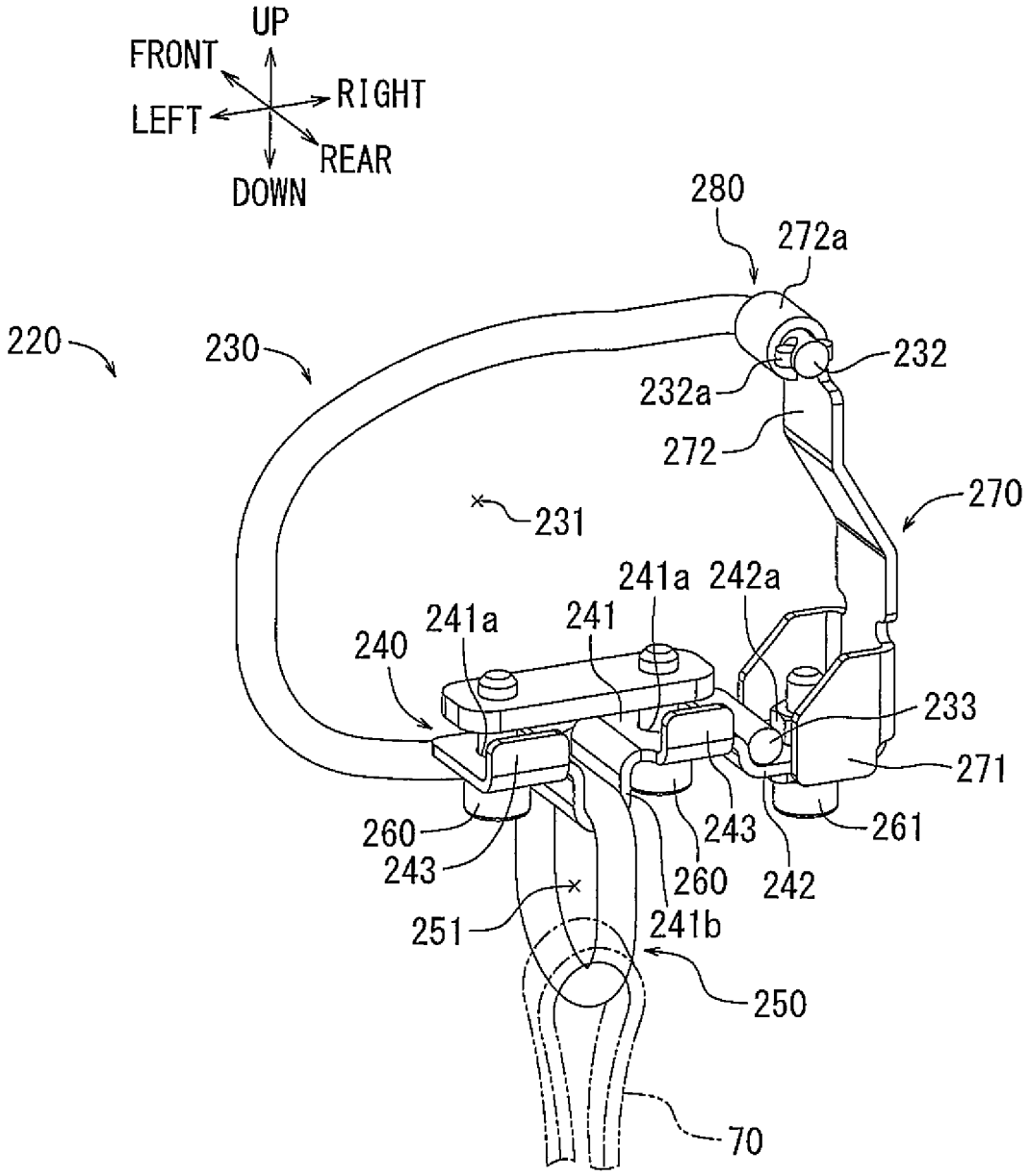
FIG. 24 illustrates the fixture body of FIG. 23 in a closed state.
Figure 25:
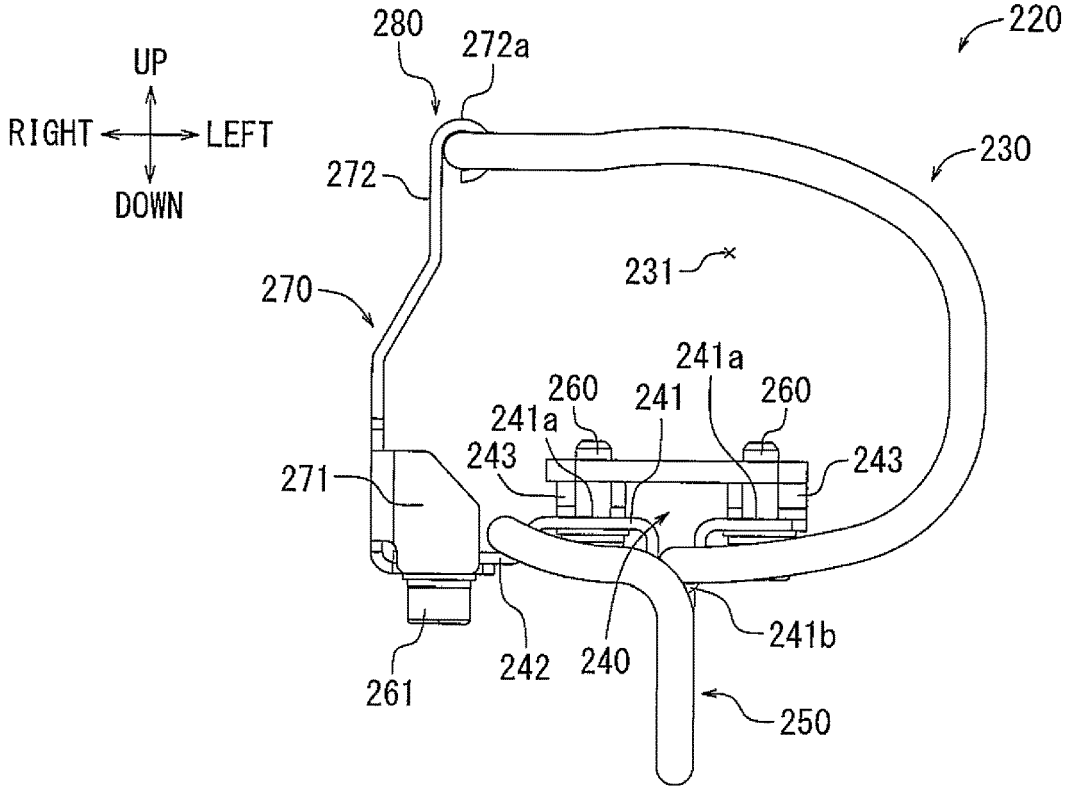
FIG. 25 is a front view of FIG. 24.
Figure 26:
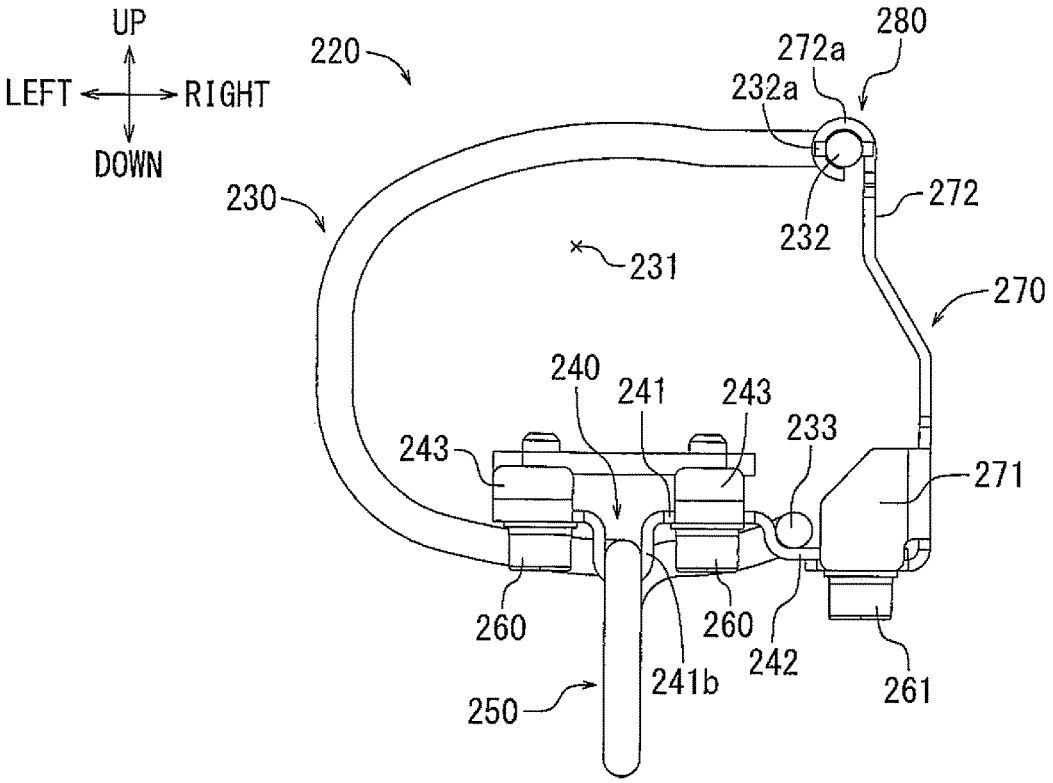
FIG. 26 is a rear view of FIG. 24.
Figure 27:
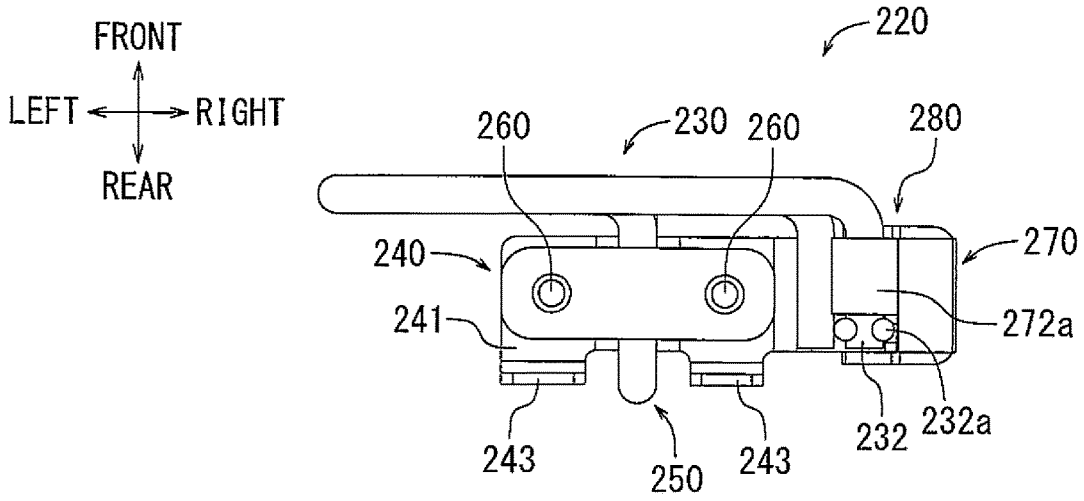
FIG. 27 is a plan view of FIG. 24.
Figure 28:
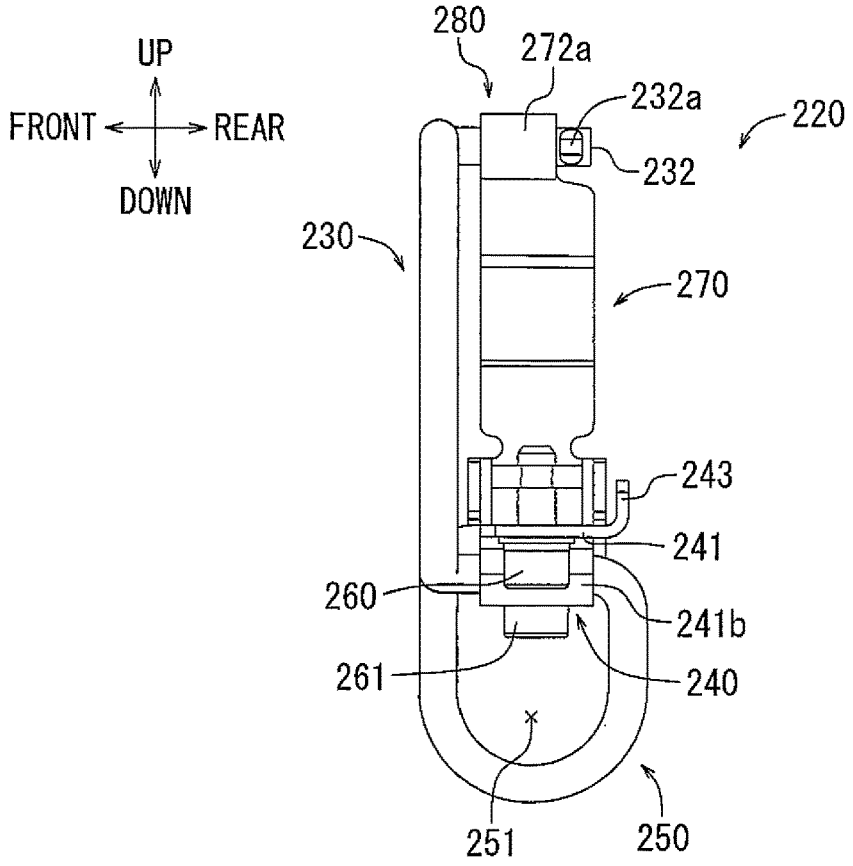
FIG. 28 is a side view of FIG. 24.
Figure 29:
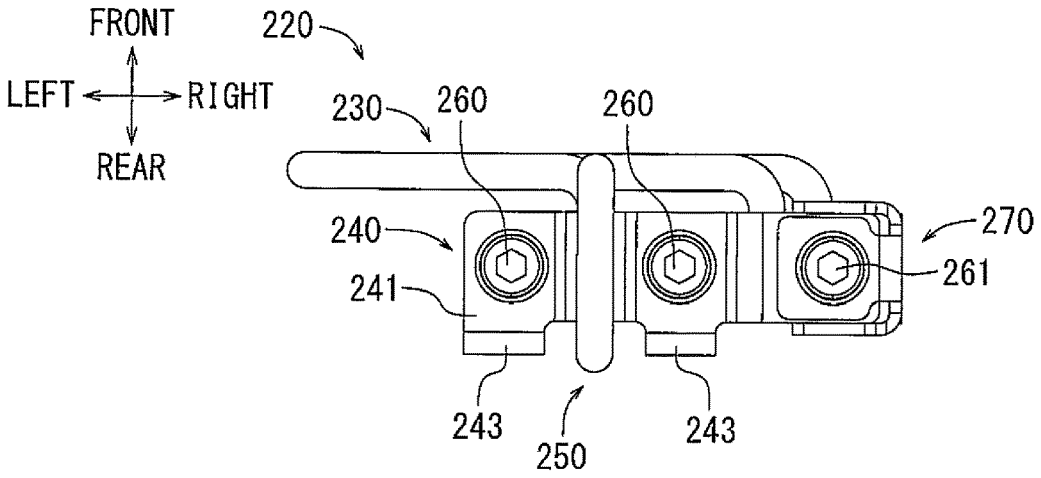
FIG. 29 is a bottom view of FIG. 24.
Figure 30:
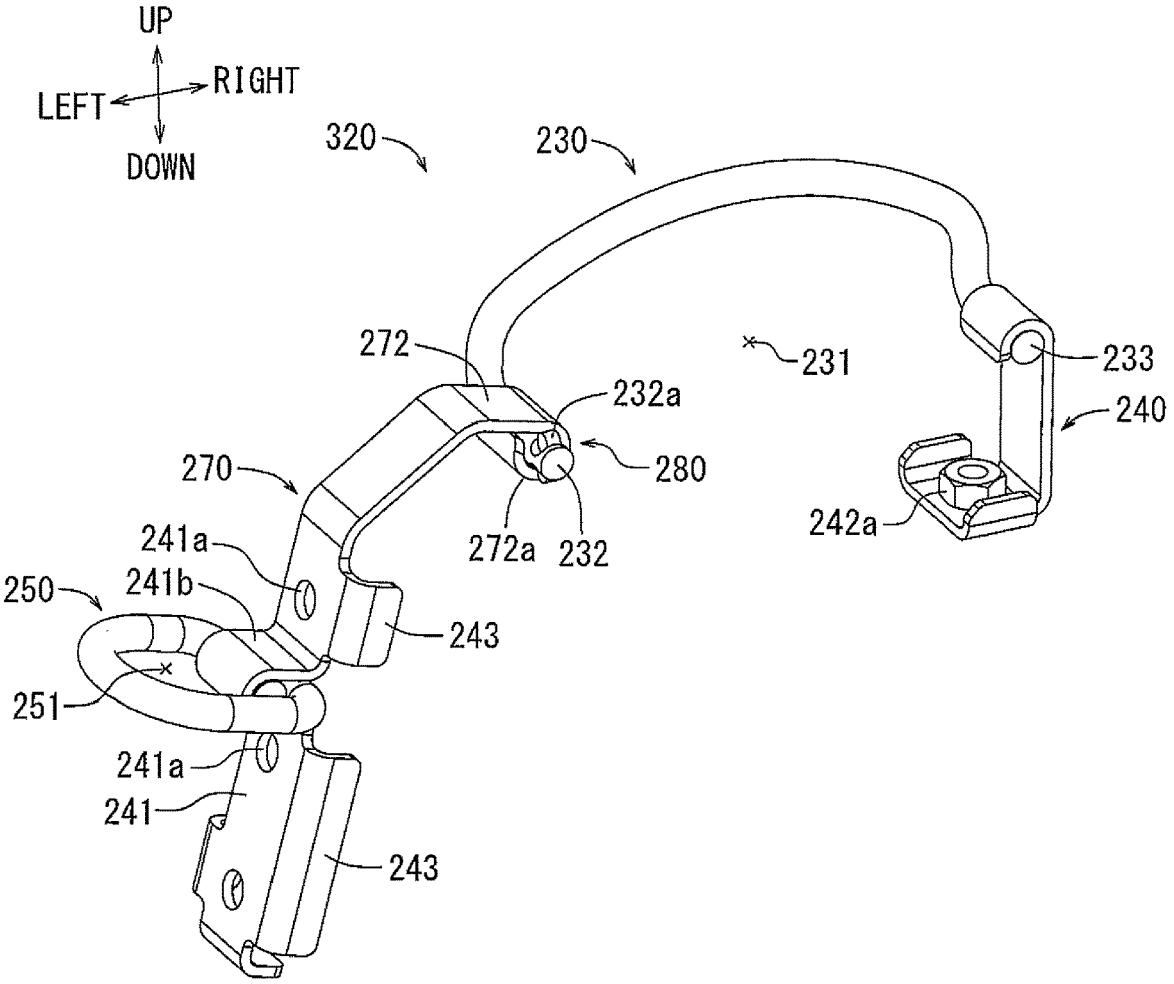
FIG. 30 is a perspective view of a coupling member according to a fourth embodiment illustrating a fixture body in an opened state.
Figure 31:
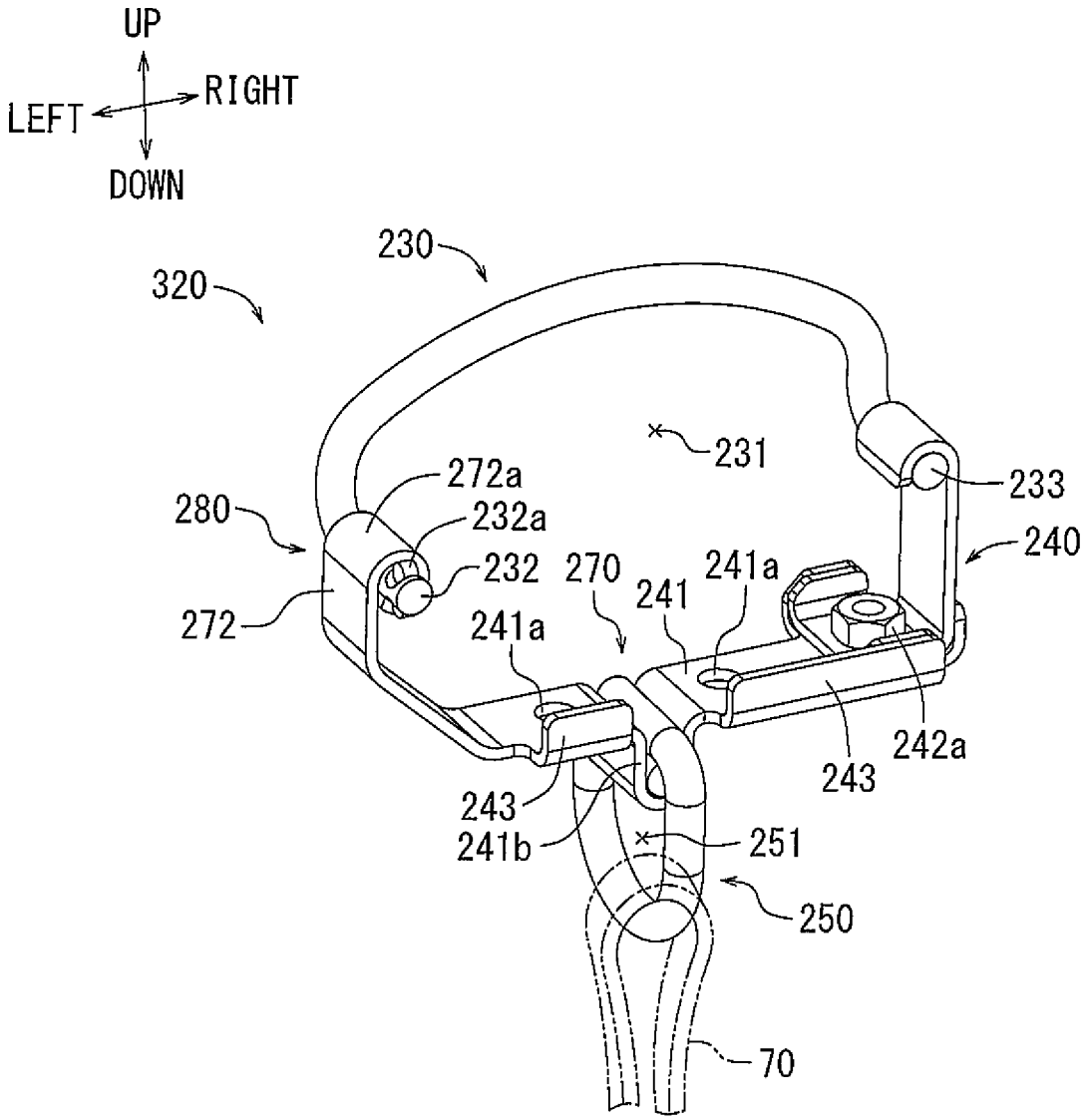
FIG. 31 illustrates the fixture body of the FIG. 30 in a closed state.
Figure 32:
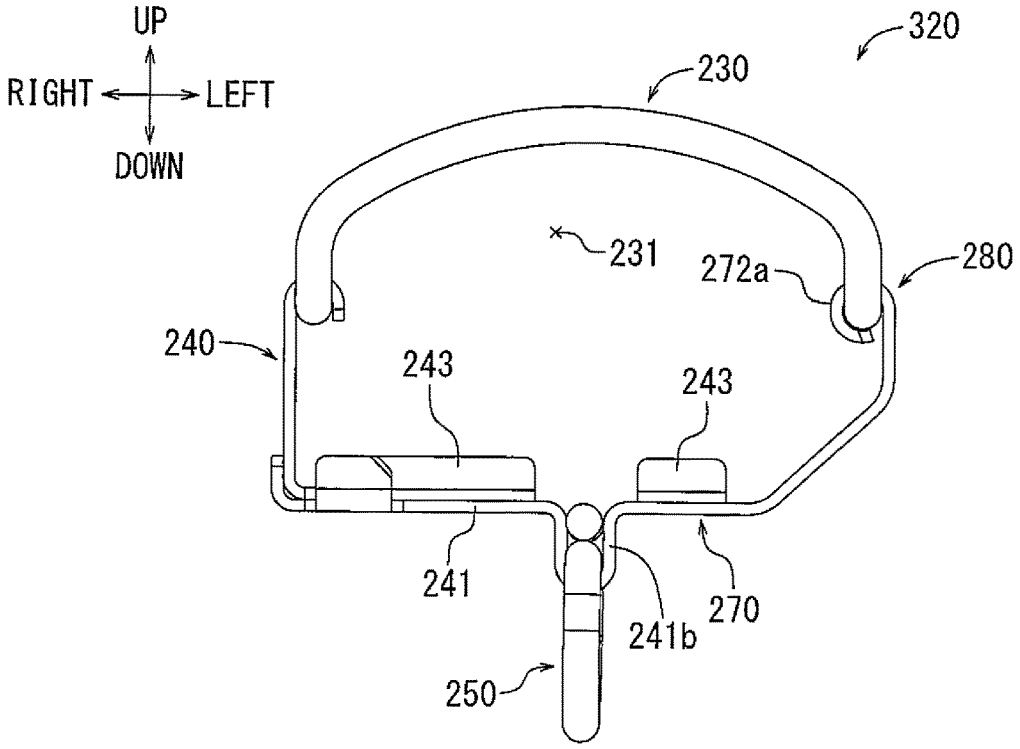
FIG. 32 is a front view of FIG. 31.
Figure 33:
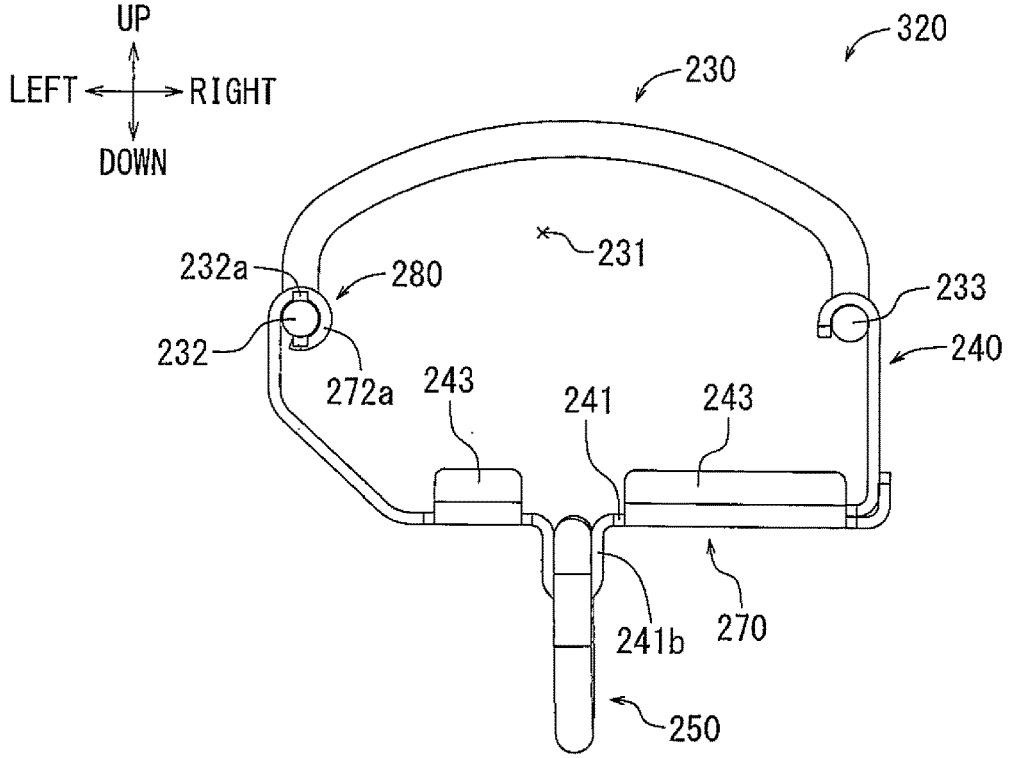
FIG. 33 is a rear view of FIG. 31.
Figure 34:
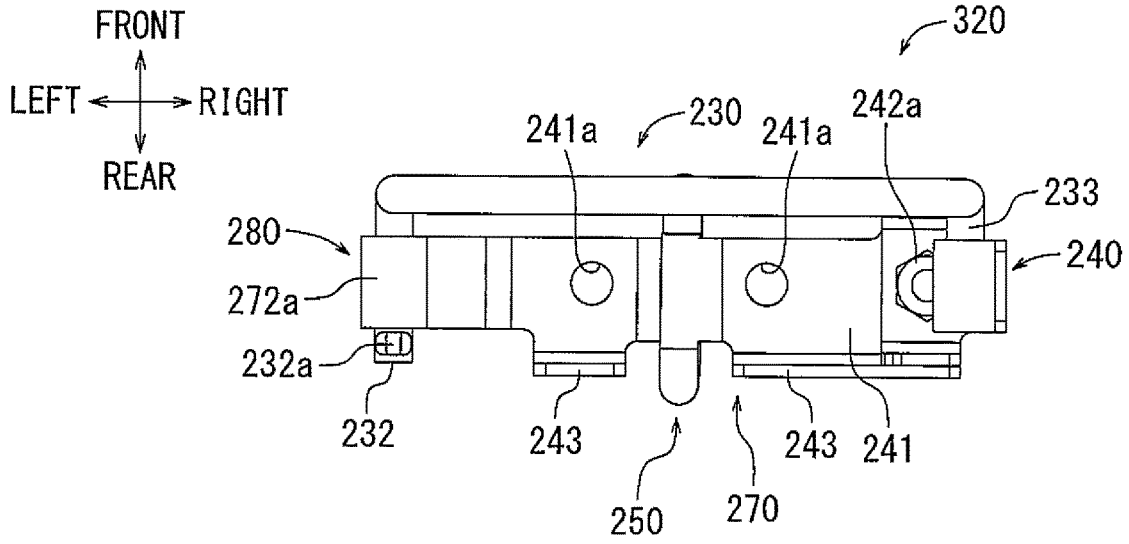
FIG. 34 is a plan view of FIG. 31.
Figure 35:
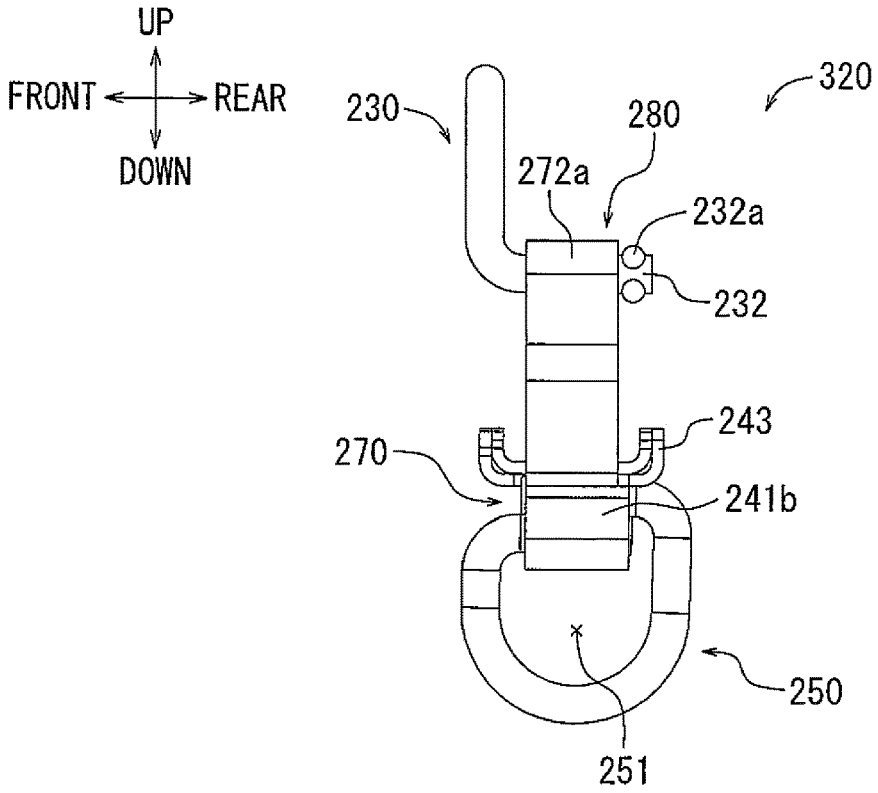
FIG. 35 is a side view of FIG. 31.
Figure 36:
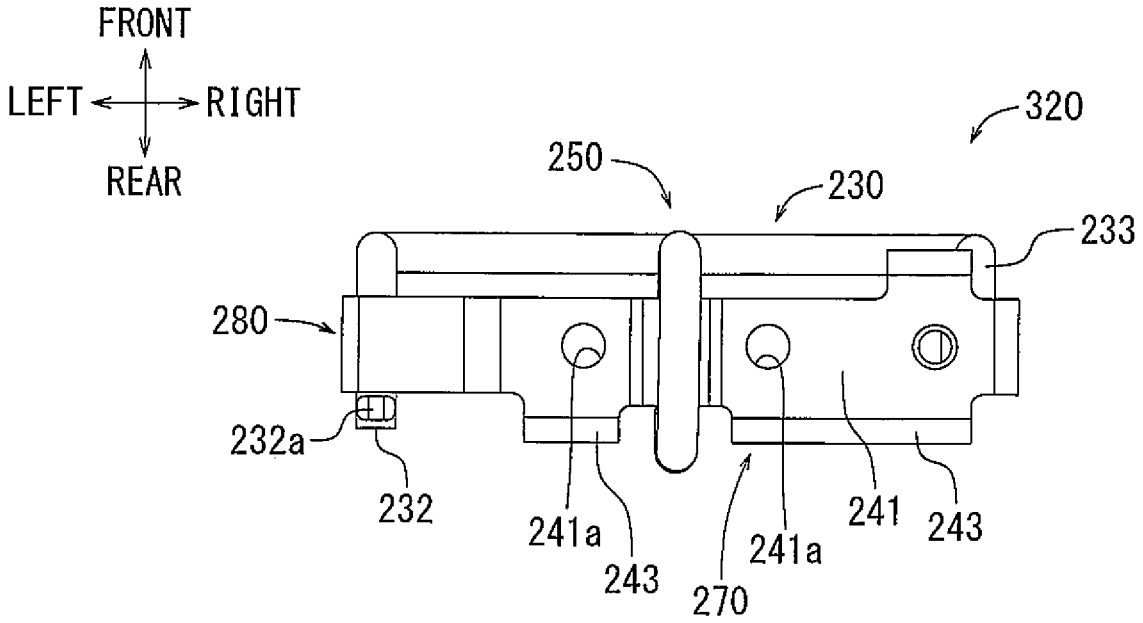
FIG. 36 is a bottom view of FIG. 31.

This allows the fastening body 230 and the fixture body 270 to rotate relative to one another about the axis of the one end 232 of the fastening body 230 (see FIGS. 23 and 24). Further, a resin sleeve (not shown) is fittedly inserted between the one end 232 of the fastening body 230 and the bent piece 272*a* of the fixture body 270 when coupled via the hinge 280. It is thus possible to prevent abnormal noises from being generated, even when the fastening body 230 is rotated relative to the fixture body 270. The coupling member 220 may be configured in this manner.

Subsequently, steps for hooking the strap 70 to the loop handle 12 of the hammer drill 1 will be described. Firstly, the fixture 270 is rotated (opened) such that the fastening space 231 of the coupling member 220 is opened (see FIG. 23). Next, the lower part 15 of the loop handle 12 of the hammer drill 1 is passed into the fastening space 231 of the coupling member 220 from the side. Next, the fixture 270 is rotated (closed) such that the fastening space 231 of the coupling member 220 fastened with the lower part 15 of the loop handle 12 is closed (see FIG. 24).

Next, screws 260 are respectively inserted into each of the insertion holes 241*a* of the attachment body 240 of the coupling member 220, such that these inserted screws 260 are screwed into each of the attachment holes (not shown) of the loop handle 12. Consequently, the attachment body 240 of the coupling member 220 is fixed to the loop handle 12 of the hammer drill 1. As a result, the attachment body 240 of the coupling member 220 is fixed to the loop handle 12 of the hammer drill 1.

Finally, the strap 70 is hooked into the through hole 251 of the coupling member 220. This allows the strap 70 to be hooked to the loop handle 12 of the hammer drill 1. Further, to remove the hooked strap 70, the above-mentioned steps can be performed in the opposite sequences.

The coupling member 220 according to the third embodiment of the present disclosure may be configured as described above. With this configuration, it is possible to obtain the same action effect as that of the coupling members 20, 120 according to the first or second embodiment.

Fourth Embodiment

Finally, a fourth embodiment of the present disclosure will be described with reference to FIGS. 30 to 36. A coupling member 320 of the fourth embodiment is an embodiment carried out such that a fastening space 231 of a coupling member 220 is fastened from above, compared to the coupling member 220 of the already described third embodiment. Therefore, as is apparent from FIGS. 30 to 36, the coupling member 320 according to the fourth embodiment is configured of similar or equivalent components as that of the coupling member 220 described with reference to the third embodiment. In the detailed description of the coupling member 320 according to the fourth embodiment, the same reference numerals in the drawings denoted substantially the same components as described in the third embodiment and, accordingly, repetition of this description will be omitted.

A coupling member 320 according to the fourth embodiment of the present disclosure may be configured as described above. With this configuration, it is possible to obtain the same action effect as that of the coupling member 20, 120, 220 according to the first to third embodiments.

The above description relates to only some embodiments of the present invention and is not intend to limit the present invention to the above description.

In each of the embodiments, the "hammer drill 1," the "loop handle 12," and the "strap 70" have been described as respective examples for an "electric power tool," an "electric power tool body," and a "hanging member". However, the scope shall not be limited to these, and may also include "various electric power tools," "various housings for electric power tools," a "hook provided on a wall, etc.," or the like.

Further, in each of the embodiments, examples have been described in which the fastening bodies 30, 130, 230, the attachment bodies 40, 140, 240, the hook parts 50, and the fixture body 270 are made of metal components. However, the scope shall not be limited to these components, and may also be made of any other materials (for example, various types of resin).

Further, in each of the embodiments, opening and closing via the "hinge 80" has been described as an example of the "opening and closing of a part of the coupling member 20." However, the scope shall not limited to this, and the device may be opened and closed by any other components, as long as a part of the coupling member 20 can be opened and closed.

Further, in each of the embodiments, the "resin sleeve 33" has been described as an example of a "silencer." However, the shall not be limited to this, and any other components may be used, as long as such a component can prevent generation of abnormal noises.

Further, in the first embodiment, the "first raised piece 42" and the "recessed groove 18 of the loop handle 12" have been respectively described as an example of an "engagement portion" and a "portion to-be-engaged". However, the scope shall not be limited to these, and may have any structure, as long as one or a pair of attachment bodies 40 may engage the loop handle 12.

What is claimed is:

1. An electric power tool comprising:

a loop handle; and a coupling member (a) configured to be (1) attached to and detached from the loop handle and (2) moved between an open state and a closed state and (b) including one or more hook part configured to receive a hanging member, wherein:

in the closed state, ends of the coupling member are adjacent;

in the open state, the ends of the coupling member are spaced apart such that the loop handle can pass between the ends; and when the coupling member is in the closed state and the loop handle is within the coupling member, the loop handle extends in opposite directions with respect to the coupling member.

2. The electric power tool as defined in claim 1, wherein the coupling member moves between the open state and the closed state via one or more hinge.

3. The electric power tool as defined in claim 2, the coupling member further comprising:

a fastening body having a fastening space to receive the loop handle; and one or more attachment body openably/closably coupled to the fastening body via the one or more hinge so as to be attached to the loop handle while the loop handle is received in the fastening body.

4. The electric power tool as defined in claim 3, wherein:

the one or more attachment body is a pair of attachment bodies;

the one or more hook part is a pair of hook parts;

each of the pair of hook parts has a through hole into which the hanging member can be hooked; and each of the through holes of the pair of the hook parts is adjacent to each other when the pair of attachment bodies are attached to the loop handle.

5. The electric power tool as defined in claim 3, wherein:

the one or more attachment body rotates along a plane between an opened position and a closed position;

the one or more attachment body has an engagement portion extending along the plane; and the engagement portion engages a recessed groove of the loop handle when the one or more attachment body is in the closed position.

6. The electric power tool as defined in claim 5, wherein the one or more attachment body is attached to the loop handle by a screw.

7. The electric power tool as defined in claim 2, wherein a silencer member is fitted and inserted into each of the one or more hinge.

8. The electric power tool as defined in claim 2, wherein:

the coupling member includes a fastening body that is coupled via the hinge such that the loop handle can be fastened therein, and a hook part configured to allow a hanging member to be hooked is integral with the fastening body.

9. The electric power tool as defined in claim 1, wherein the opposite directions are perpendicular to a plane of movement of the coupling member when the coupling member moves between the closed state and the open state.

10. An electric power tool comprising:

a loop handle; and a coupling member (a) configured to be attached to and detached from the loop handle and (b) including:

a fastening body having a fastening space to receive the loop handle;

an attachment body attached to a first end of the fastening body and configured to be attached to the loop handle; and a hinge on the fastening body and configured such that the attachment body can be moved between an open state and a closed state via the hinge, wherein:

the loop handle can pass through the coupling member when the attachment body is in the open state;

the loop handle cannot pass through the coupling member when the attachment body is in the closed state; and when the attachment body is in the closed state and the loop handle is in the fastening space, the loop handle extends in opposite directions with respect to the coupling member.

11. The electric power tool as defined in claim 10, wherein:

the fastening body comprises a first fastening body and a second fastening body; and the first fastening body and the second fastening body are connected via the hinge.

12. The electric power tool as defined in claim 10, further comprising a hook part configured to receive a hanging member.

13. The electric power tool as defined in claim 12, wherein the hook part is integral with the fastening body.

14. The electric power tool as defined in claim 12, wherein the hook part is attached to the attachment body.

15. The electric power tool as defined in claim 14, wherein the hook part projects in a direction away from the fastening space when the attachment body is attached to the loop handle.

16. The electric power tool as defined in claim 10, wherein:

the attachment body comprises an engagement portion projecting outwardly, and the engagement portion is configured to project toward the fastening space when the attachment body is attached to the loop handle.

17. The electric power tool as defined in claim 16, wherein the engagement portion is configured to rotate about the hinge when the fastening body moves from the closed state to the open state.

18. The electric power tool as defined in claim 16, further comprising a hook part that is farther from the fastening space than the engagement portion when the attachment body is attached to the loop handle.

19. The electric power tool as defined in claim 10, further comprising a fixture body rotatable about the hinge, wherein the fixture body is configured to rotate about the hinge so as to close the fastening space.

20. The electric power tool as defined in claim 10, wherein the opposite directions are parallel to an axis of rotation of the hinge.

* * * * *